US008393389B2

(12) United States Patent
Brisco et al.

(10) Patent No.: US 8,393,389 B2
(45) Date of Patent: Mar. 12, 2013

(54) RUNNING TOOL FOR EXPANDABLE LINER HANGER AND ASSOCIATED METHODS

(75) Inventors: David P. Brisco, Duncan, OK (US); Brock W. Watson, Carrollton, TX (US); Ralph H. Echols, Plano, TX (US)

(73) Assignee: Halliburton Evergy Services, Inc., Houston, TX (US)

( * ) Notice: Subject to any disclaimer, the term of this patent is extended or adjusted under 35 U.S.C. 154(b) by 0 days.

(21) Appl. No.: 11/737,868

(22) Filed: Apr. 20, 2007

(65) Prior Publication Data

US 2008/0257560 A1 Oct. 23, 2008

(51) Int. Cl.
*E21B 23/00* (2006.01)

(52) U.S. Cl. ..... 166/217; 166/208; 166/212

(58) Field of Classification Search ..... 166/382, 166/208, 124, 207, 212
See application file for complete search history.

(56) References Cited

U.S. PATENT DOCUMENTS 2,259,232 A * 10/1941 Stone ..... 175/325.5
2,342,930 A 2/1944 Fortune
3,077,933 A * 2/1963 Bigelow ..... 166/217
3,219,116 A 11/1965 Matthews, Jr.
3,871,449 A * 3/1975 Ahlstone ..... 166/183
4,251,176 A 2/1981 Sizer et al.
4,388,971 A 6/1983 Peterson
4,391,325 A 7/1983 Baker et al.
4,681,168 A 7/1987 Kisling, III
4,848,469 A * 7/1989 Baugh et al. ..... 166/382
4,911,237 A * 3/1990 Melenyzer ..... 166/208
4,926,936 A * 5/1990 Braddick ..... 166/217
5,070,941 A 12/1991 Kilgore
5,318,131 A 6/1994 Baker
5,697,449 A * 12/1997 Hennig et al. ..... 166/382
6,012,523 A 1/2000 Campbell et al.
6,053,262 A * 4/2000 Ferguson et al. ..... 175/321
6,241,018 B1 * 6/2001 Eriksen ..... 166/215
6,467,547 B2 10/2002 Maguire et al.
6,648,075 B2 11/2003 Badrak et al.
6,817,421 B2 11/2004 Dallas
6,854,521 B2 2/2005 Echols et al.
6,915,852 B2 7/2005 Baugh et al.
7,011,162 B2 3/2006 Maguire
7,048,065 B2 5/2006 Badrak et al.
7,077,211 B2 7/2006 Cook et al.

(Continued)

OTHER PUBLICATIONS

Halliburton drawing No. 59VRT7096400, "Setting Tool Assembly," dated Dec. 22, 2006.

(Continued)

*Primary Examiner* — Daniel P Stephenson
*Assistant Examiner* — Yong-Suk (Philip) Ro
(74) *Attorney, Agent, or Firm* — Smith IP Services, P.C.

(57) ABSTRACT

A running tool includes subassemblies which release the running tool from the liner hanger in response to application of alternating tensile and compressive forces after application of left-hand torque. A running tool includes subassemblies which set the liner hanger in response to left-hand torque followed by increased pressure, and in response to increased pressure without prior left-hand torque being applied. A running tool includes threaded connections, without torque transmitted through the running tool being transmitted by the threaded connections. A method of setting a liner hanger includes applying a compressive force to the running tool; then applying left-hand torque to the running tool; and then applying a tensile force to the running tool. A method of releasing a liner hanger includes applying left-hand torque to the running tool; and then releasing the running tool from the liner hanger by applying a tensile force to the running tool.

26 Claims, 24 Drawing Sheets

U.S. PATENT DOCUMENTS

| | | | | |
|---|---|---|---|---|
| 7,090,005 | B2 | 8/2006 | Smith, Jr. et al. | |
| 7,124,829 | B2 | 10/2006 | Braddick | |
| 7,128,147 | B2 * | 10/2006 | Marcin et al. | 166/208 |
| 7,152,684 | B2 | 12/2006 | Harrall et al. | |
| 7,156,182 | B2 | 1/2007 | Lynde et al. | |
| 7,159,666 | B2 | 1/2007 | Nobileau | |
| 7,172,027 | B2 | 2/2007 | Simpson et al. | |
| 7,185,701 | B2 | 3/2007 | Mackenzie | |
| 7,216,701 | B2 | 5/2007 | Cook et al. | |
| 7,225,879 | B2 | 6/2007 | Wylie et al. | |
| 7,225,880 | B2 | 6/2007 | Braddick | |
| 7,240,729 | B2 | 7/2007 | Cook et al. | |
| 7,278,492 | B2 | 10/2007 | Braddick | |
| 7,350,563 | B2 | 4/2008 | Waddell et al. | |
| 7,441,606 | B2 | 10/2008 | Maguire | |
| 7,543,637 | B2 | 6/2009 | Green et al. | |
| 2002/0070032 | A1 | 6/2002 | Maguire et al. | |
| 2003/0155159 | A1 * | 8/2003 | Slack et al. | 175/423 |
| 2003/0230410 | A1 | 12/2003 | Underhill | |
| 2004/0173361 | A1 | 9/2004 | Lohbeck | |
| 2004/0256112 | A1 | 12/2004 | Harrall et al. | |
| 2005/0145417 | A1 | 7/2005 | Radford et al. | |
| 2005/0241834 | A1 | 11/2005 | McGlothen et al. | |
| 2005/0263292 | A1 * | 12/2005 | Braddick | 166/382 |
| 2005/0279514 | A1 | 12/2005 | Metcalfe | |
| 2006/0196656 | A1 * | 9/2006 | McGlothen et al. | 166/208 |
| 2006/0272807 | A1 | 12/2006 | Adam et al. | |
| 2007/0000664 | A1 | 1/2007 | Ring et al. | |
| 2007/0029095 | A1 * | 2/2007 | Brisco et al. | 166/380 |
| 2007/0187113 | A1 | 8/2007 | Hester | |
| 2008/0257560 | A1 | 10/2008 | Brisco et al. | |
| 2009/0107686 | A1 | 4/2009 | Watson | |
| 2011/0011320 | A1 | 1/2011 | Yemington | |

OTHER PUBLICATIONS

Halliburton, "Completion Tools, Versaflex® Stimulation Acid Washdown (SAW) System," dated Apr. 2007.

Halliburton, "Versaflex™ Expandable Liner System," undated.

Halliburton, "Versaflex® Liner Hanger System," undated.

Halliburton, Versaflex brochure, dated Nov. 2006.

International Search Report for International Application No. PCT/US08/60106 dated Aug. 21, 2008.

Written Opinion of the International Searching Authority for International Application No. PCT/US08/60106 dated Aug. 21, 2008.

International Search Report and Written Opinion issued Feb. 13, 2009, for International Patent Application No. PCT/US08/80423, 9 pages.

International Preliminary Report on Patentability and Written Opinion issued for International Patent Application No. PCT/US2008/060106 dated Oct. 29, 2009, 7 pages.

Partial International Search Report issued for International Patent Application No. PCT/US2009/068008 dated Mar. 16, 2010, 7 pages.

Office Action issued May 12, 2010, for U.S. Appl. No. 11/923,374, 15 pages.

International Preliminary Report on Patentability issued May 6, 2010, for International Patent Application No. PCT/US08/80423, 7 pages.

International Search Report and Written Opinion issued May 31, 2010, for International Patent Application No. PCT/US09/068008, 19 pages.

Office Action issued Aug. 31, 2010, for U.S. Appl. No. 11/923,374, 11 pages.

Examination Report issued Dec. 23, 2010, for AU Patent Application No. 2008242341, 2 pages.

Office Action issued Dec. 9, 2010 for U.S. Appl. No. 12/342,718, 30 pages.

Office Action issued Jan. 8, 2010, for U.S. Appl. No. 11/923,374, 24 pages.

Office Action issued Aug. 19, 2011 for U.S. Appl. No. 13/053,896, 18 pages.

International Preliminary Report on Patentability issued Jul. 7, 2011 for International Patent Application No. PCT/US09/068008, 10 pages.

Office Action issued Jun. 17, 2011 for U.S. Appl. No. 12/342,718, 9 pages.

Canadian Office Action issued Apr. 2, 2012 for CA Patent Application No. 2,684,547, 2 pages.

Office Action issued Jun. 2, 2012 for U.S. Appl. No. 13/053,896, 12 pages.

Office Action issued Nov. 30, 2011 for U.S. Appl. No. 13/053,896, 16 pages.

Chinese Office Action issued May 21, 2012 for CN Patent application No. 200880021044.5, 4 pages.

English translation of Chinese Office Action issued May 21, 2012 for CN Patent application No. 200880021044.5, 7 pages.

International Search Report with Written Opinion issued Jun. 29, 2012 for PCT Patent Application No. PCT/US11/060617, 11 pages.

* cited by examiner

RUNNING TOOL FOR EXPANDABLE LINER HANGER AND ASSOCIATED METHODS

BACKGROUND

The present invention relates generally to equipment utilized and operations performed in conjunction with a subterranean well and, in an embodiment described herein, more particularly provides a running tool for an expandable liner hanger and associated methods.

Expandable liner hangers are generally used to secure a liner within a previously set casing or liner string. These types of liner hangers are typically set by expanding the liner hangers radially outward into gripping and sealing contact with the previous casing or liner string. Many such liner hangers are expanded by use of hydraulic pressure to drive an expanding cone or wedge through the liner hanger, but other methods may be used (such as mechanical swaging, explosive expansion, memory metal expansion, swellable material expansion, electromagnetic force-driven expansion, etc.).

The expansion process is typically performed by means of a running tool used to convey the liner hanger and attached liner into a wellbore. The running tool is interconnected between a work string (e.g., a tubular string made up of drill pipe or other segmented or continuous tubular elements) and the liner hanger.

If the liner hanger is expanded using hydraulic pressure, then the running tool is generally used to control the communication of fluid pressure, and flow to and from various portions of the liner hanger expansion mechanism, and between the work string and the liner. The running tool may also be used to control when and how the work string is released from the liner hanger, for example, after expansion of the liner hanger, in emergency situations, or after an unsuccessful setting of the liner hanger.

The running tool is also usually expected to provide for cementing therethrough, in those cases in which the liner is to be cemented in the wellbore. Furthermore, the running tool is preferably capable of transmitting torque from the work string to the liner, for example, to remediate sticking of the liner in the wellbore, enable the liner to be used as a drill string to further drill the wellbore (in which case a drill bit may be connected to an end of the liner), etc.

It will, thus, be appreciated that many functions are performed by an expandable liner hanger running tool. If these functions are to be performed effectively and reliably, then the operation of the running tool should be appropriately tailored to the environment in which it is to be used.

Unfortunately, past running tool designs have fallen short in one or more respects. Some designs, for example, require a ball or other plug to be dropped through the work string at the completion of the cementing operation and prior to expanding the liner hanger. However, at substantial depths and/or in highly deviated wellbores, it may take a very long time for the ball to reach the running tool (during which time the cement is setting), or the ball may not reach the running tool at all.

Other running tool designs use a release mechanism which operates by shearing pins in response to set down weight (compressive force in the work string). If this set down weight is applied prematurely (e.g., if the liner becomes stuck) or not at all (e.g., in a highly deviated wellbore), then the liner hanger may be released prematurely or not at all.

Still other running tool designs use a release mechanism which operates in response to right-hand (clockwise) torque applied to the work string, or are otherwise incapable of transmitting substantial torque from the work string to the liner. These designs do not allow the liner to be used as a drill string, and do not allow right-hand torque to be used in some circumstances to free a stuck liner.

It will, therefore, be appreciated that improvements are needed in the art of expandable liner hanger running tools and associated methods of installing expandable liner hangers. These improvements can include improvements to operational efficiency, convenience of assembly and operation, improved functionality, etc. not discussed above.

SUMMARY

In carrying out the principles of the present invention, a running tool and associated methods are provided which solve at least one problem in the art. One example is described below in which the running tool uses left-hand torque to initiate an alternative setting procedure or a contingent release procedure. Another example is described below in which compressive force may be applied to the running tool at any time prior to applying a predetermined left-hand torque to the running tool, without the compressive force causing the running tool to release from the liner hanger.

In one aspect, a method of releasing a liner hanger running tool from a liner hanger is provided. The method includes the steps of: applying left-hand torque to the running tool; and then releasing the running tool from the liner hanger by applying a tensile force to the running tool.

In another aspect, a method of setting a liner hanger includes the steps of: conveying the liner hanger into a wellbore using a running tool; applying a compressive force to the running tool; then applying left-hand torque to the running tool; and then applying a tensile force to the running tool.

In yet another aspect, a running tool for conveying and setting a liner hanger in a subterranean well is provided. The running tool includes threaded connections between end connections at opposite ends of the running tool. The threaded connections connect multiple components of the running tool to each other. Torque transmitted through the running tool is not transmitted by threads of the threaded connections.

In a further aspect, a running tool for conveying and setting a liner hanger in a subterranean well includes various subassemblies capable of setting the liner hanger in response to left-hand torque applied to the running tool followed by increased pressure applied to the running tool. The subassemblies are further capable of setting the liner hanger in response to increased pressure applied to the running tool without prior left-hand torque being applied to the running tool.

In a still further aspect, a running tool for conveying and setting a liner hanger in a subterranean well includes subassemblies capable of releasing the running tool from the liner hanger in response to application of alternating tensile and compressive forces to the running tool after application of left-hand torque to the running tool.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
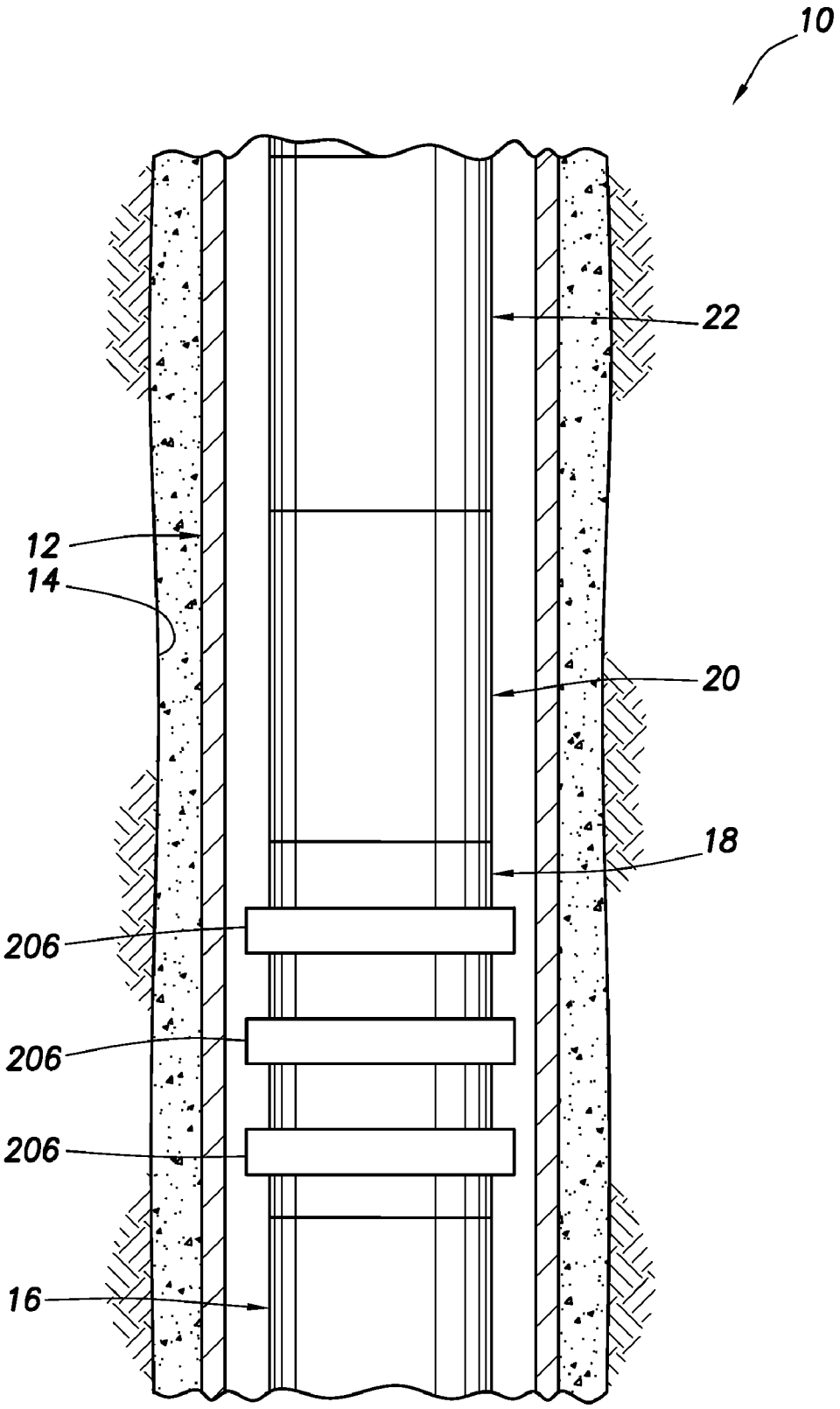
FIG. 1 is a schematic partially cross-sectional view of a liner hanger setting system and associated methods which embody principles of the present invention.

Representatively illustrated in FIG. 1 is a liner hanger setting system 10 and associated method which embody principles of the present invention. In this system 10, a casing string 12 has been installed and cemented within a wellbore 14. It is now desired to install a liner 16 extending outwardly from a lower end of the casing string 12, in order to further line the wellbore 14 at greater depths.

Note that, in this specification, the terms "liner" and "casing" are used interchangeably to describe tubular materials which are used to form protective linings in wellbores. Liners and casings may be made from any material (such as metals, plastics, composites, etc.), may be expanded or unexpanded as part of an installation procedure, and may be segmented or continuous. It is not necessary for a liner or casing to be cemented in a wellbore. Any type of liner or casing may be used in keeping with the principles of the present invention.

As depicted in FIG. 1, an expandable liner hanger 18 is used to seal and secure an upper end of the liner 16 near a lower end of the casing string 12. Alternatively, the liner hanger 18 could be used to seal and secure the upper end of the liner 16 above a window (not shown in FIG. 1) formed through a sidewall of the casing string 12, with the liner extending outwardly through the window into a branch or lateral wellbore. Thus, it will be appreciated that many different configurations and relative positions of the casing string 12 and liner 16 are possible in keeping with the principles of the invention.

A running tool 20 is connected between the liner hanger 18 and a work string 22. The work string 22 is used to convey the running tool 20, liner hanger 18 and liner 16 into the wellbore 14, conduct fluid pressure and flow, transmit torque, tensile and compressive force, etc. The running tool 20 is used to facilitate conveyance and installation of the liner 16 and liner hanger 18, in part by using the torque, tensile and compressive forces, fluid pressure and flow, etc. delivered by the work string 22.

At this point, it should be specifically understood that the principles of the invention are not to be limited in any way to the details of the system 10 and associated methods described herein. Instead, it should be clearly understood that the system 10, methods, and particular elements thereof (such as the running tool 20, liner hanger 18, liner 16, etc.) are only examples of a wide variety of configurations, alternatives, etc. which may incorporate the principles of the invention.

Referring additionally now to FIGS. 2A-L, detailed cross-sectional views of successive axial portions of the liner hanger 18 and running tool 20 are representatively illustrated. FIGS. 2A-L depict a specific configuration of one embodiment of the liner hanger 18 and running tool 20, but many other configurations and embodiments are possible without departing from the principles of the invention.

The liner hanger 18 and running tool 20 are shown in FIGS. 2A-L in the configuration in which they are conveyed into the wellbore 14. The work string 22 is attached to the running tool 20 at an upper threaded connection 24, and the liner 16 is attached to the liner hanger 18 at a lower threaded connection 26 when the overall assembly is conveyed into the wellbore 14.

The running tool 20 is made up of several subassemblies, including an upper adapter subassembly 28, piston mandrel subassembly 30, and valve sleeve mandrel subassembly 32.

The upper adapter subassembly 28 consists of an upper adapter 34, baffle 36, lug body 38, locking dogs sleeve 40, locking dogs 42, and locking dogs retainer 44. The upper adapter 34 connects the running tool 20 to the work string 22.

The lug body 38 is made up on the bottom of the upper adapter 34 and contains internal lugs 46 which support the weight of the running tool 20, liner hanger 18, and the liner 16. The internal lugs 46 are assembled in longitudinal slots 48*a, b* in a slot mandrel 50 and locate the upper adapter subassembly 28 in different positions relative to the rest of the running tool 20. The slots 48*a, b* may be of the type known to those skilled in the art as "J-slots," since they may have a generally J-shaped profile.

The locking dogs sleeve 40 is made up on the bottom of the lug body 38. Screws 52 are made up through holes in the lug body 38 and into threaded holes in the locking dogs sleeve 40, aligning holes through the lug body and locking dogs sleeve. Alignment of the lug body lugs 46 with slots 48 in the slot mandrel 50 align these holes through the lug body and locking dogs sleeve and other holes 54 in the lower end of the locking dogs sleeve 40 with shear pin holes 56 in the torque ring 62 and piston mandrel 64. This allows access to shear pins 58 after the running tool 20 is assembled so shear pins can be added or removed without disassembling the running tool.

The locking dogs 42 are assembled against the lower end of the locking dogs sleeve 40. The locking dogs retainer 44 is made up to the lower end of the locking dogs sleeve 40 over the locking dogs 42.

The piston mandrel subassembly 30 is located in the upper adapter subassembly 28. It consists of the shoe 60, slot mandrel 50, torque ring 62, piston mandrel 64, release lock 66, piston 68, valve release sleeve 70, and cap 72. The slot mandrel 50, as mentioned above, is located in the lug body 38. Each internal lug 46 in the lug body 38 is positioned in one of two sets of longitudinal slots 48*a, b* on the slot mandrel 50.

The two sets of slots 48*a, b* (one long and one short), are connected to each other at the lower end of the slot mandrel 50 so the lugs 46 can move from one set to the next. When the lugs 46 are in the short slots 48*a*, they can move upward and engage an external shoulder 74 at the upper end of the short slots.

In this position, the lugs 46 can bear against the sides of the short slots 48*a*, transferring left-hand and right-hand torque from the lug body 38 to the slot mandrel 50. Right-hand torque can also be transferred from the lug body 38 to the slot mandrel 50 when the lugs 46 are at the lower end of the short slots 48*a*.

When the lugs 46 are in the long slots 48*b*, they can move upward and shoulder against the lower end of the shoe 60 which is made up on the upper end of the slot mandrel 50. The upper end of the long slots 48*b* have a pocket 76 machined at one side into which the lugs 46 can be rotated (see FIG. 16).

Left-hand and right-hand torque can be transferred from the lug body 38 to the slot mandrel 50 when the lugs 46 are at the upper end of the long slots 48*b*. The lugs 46 can shoulder against the lower side of the pockets 76, allowing the lugs to push down on the slot mandrel 50.

Figure 2A:
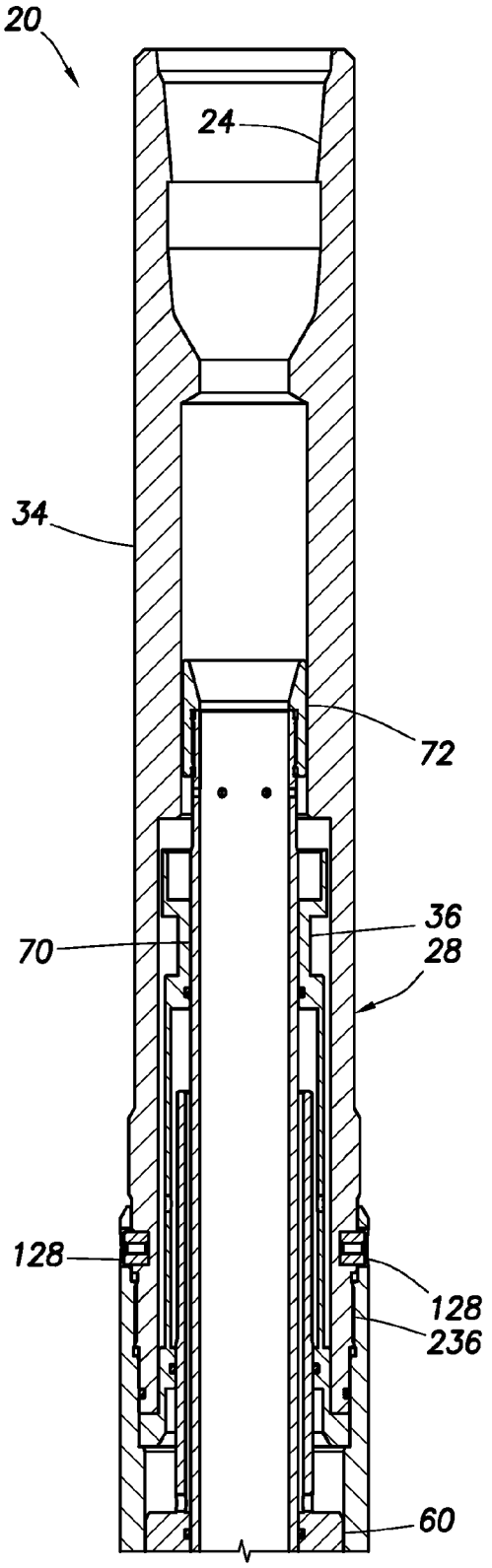
FIGS. 2A-L are cross-sectional views of successive axial sections of a liner hanger running tool and expandable liner hanger which may be used in the system and method of FIG. 1, the running tool and liner hanger being illustrated in a run-in configuration.
Figure 2B:
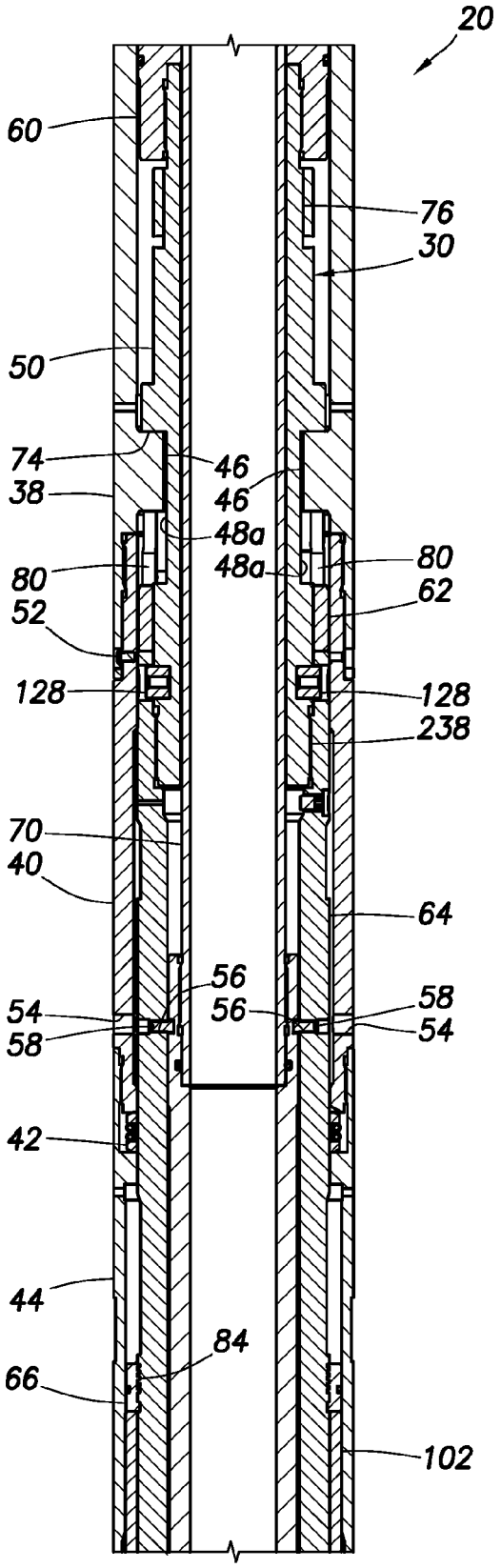
Figure 2C:
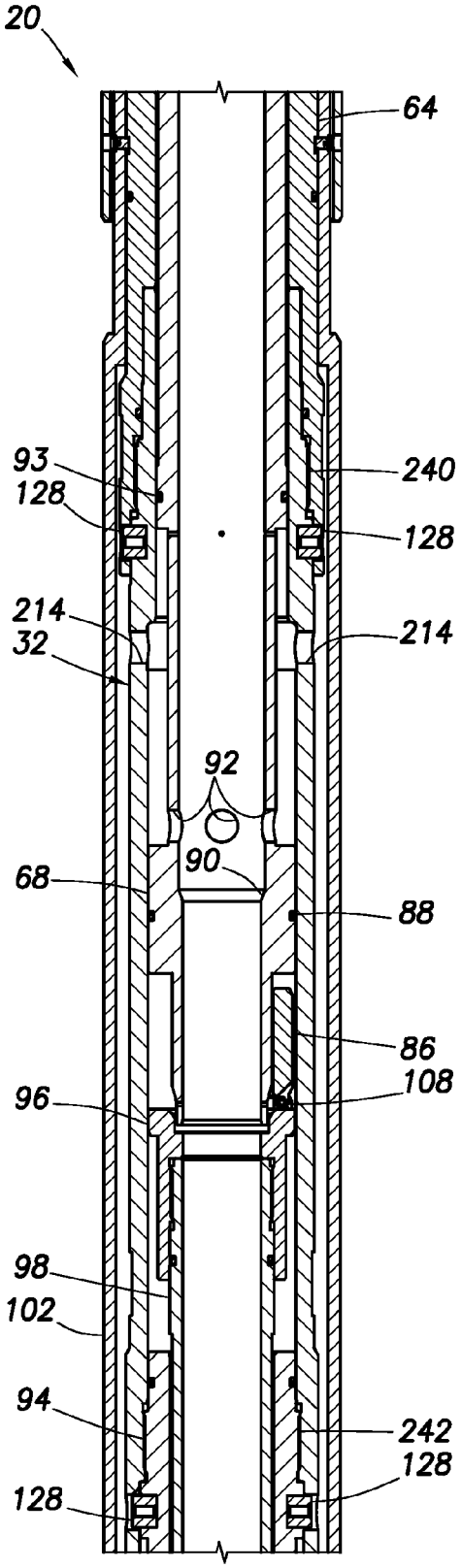
Figure 2D:
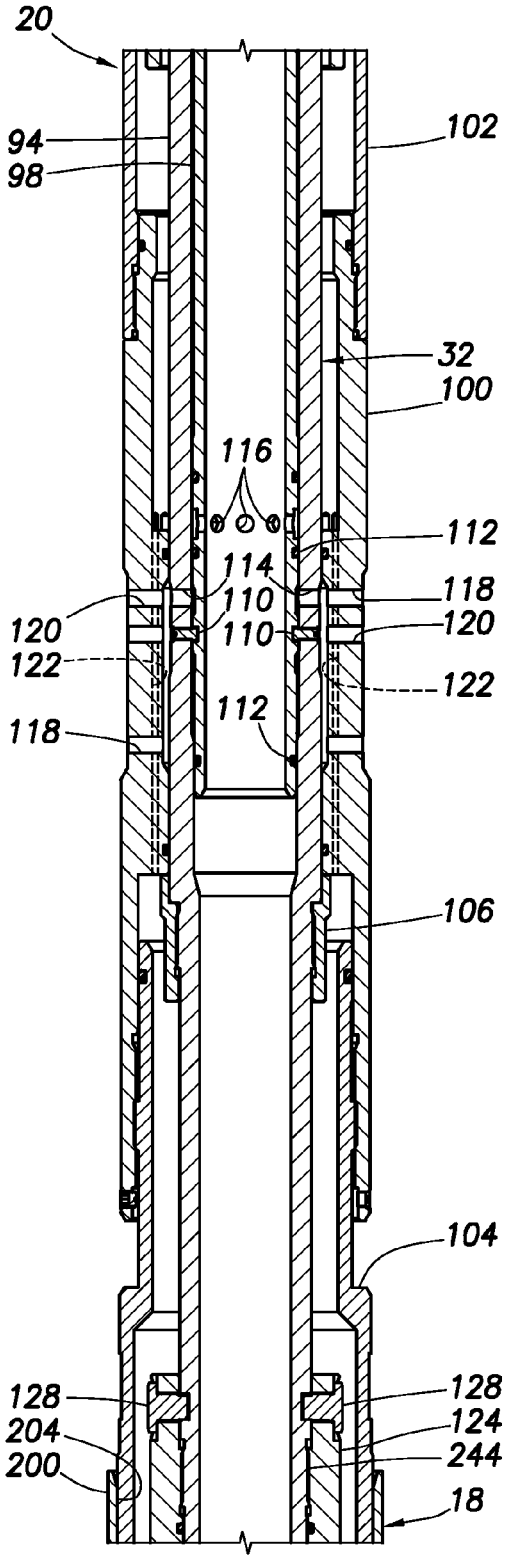
Figure 2E:
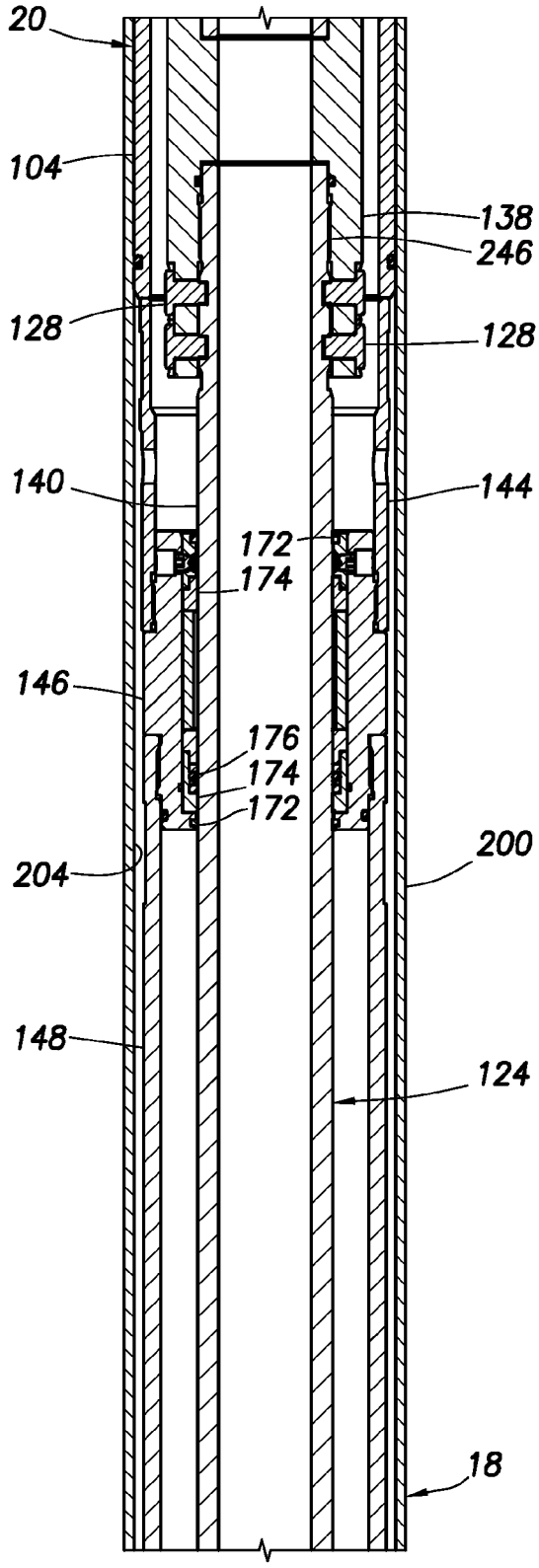
Figure 2F:
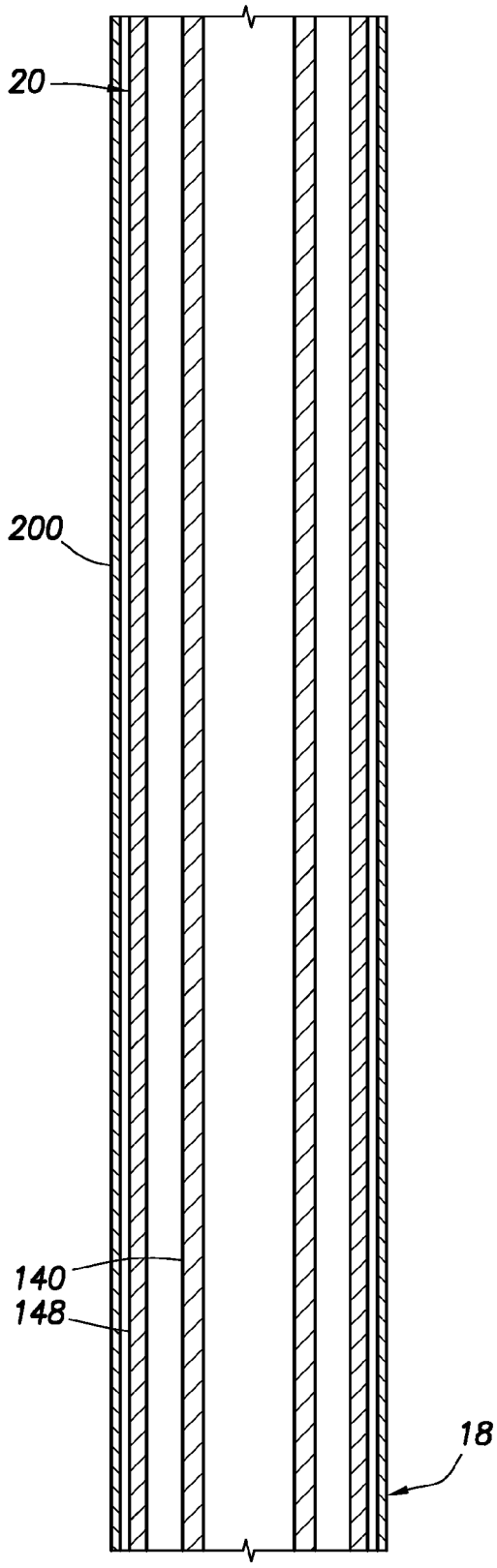
Figure 2G:
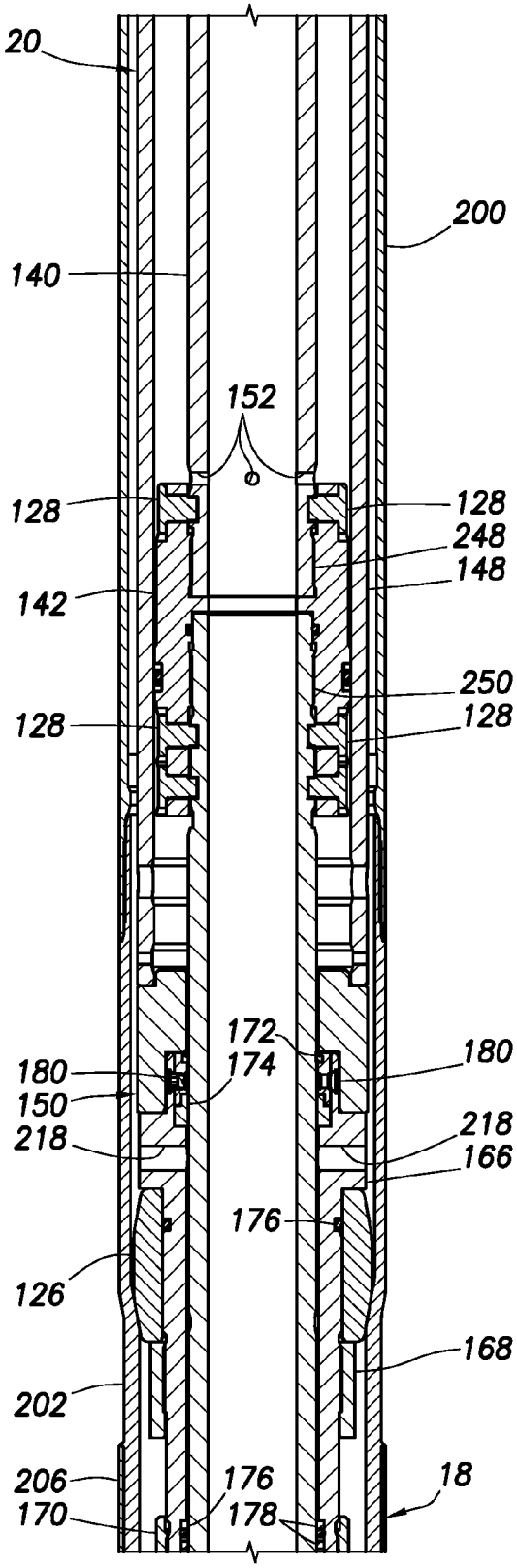
Figure 2H:
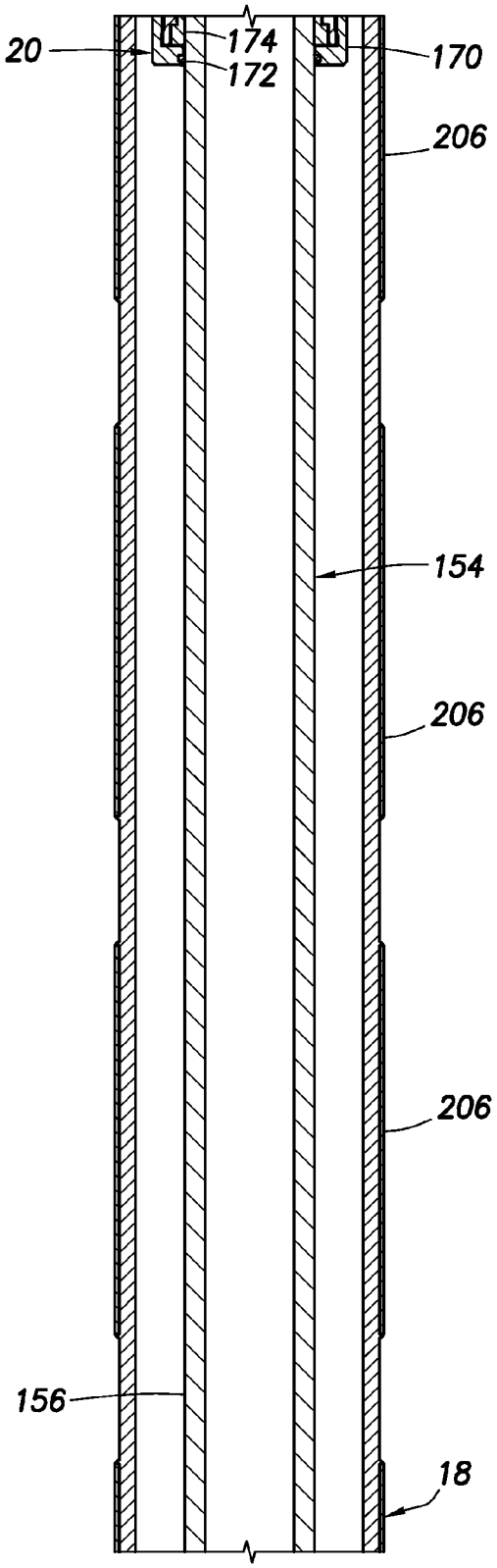
Figure 2I:
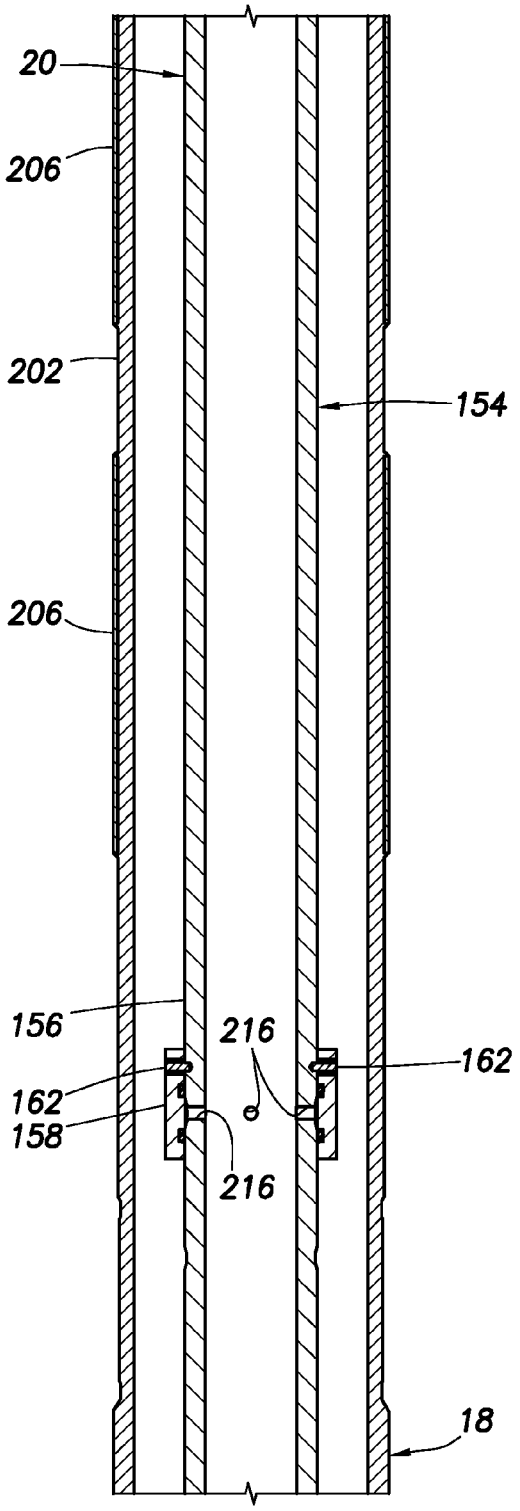
Figure 2J:
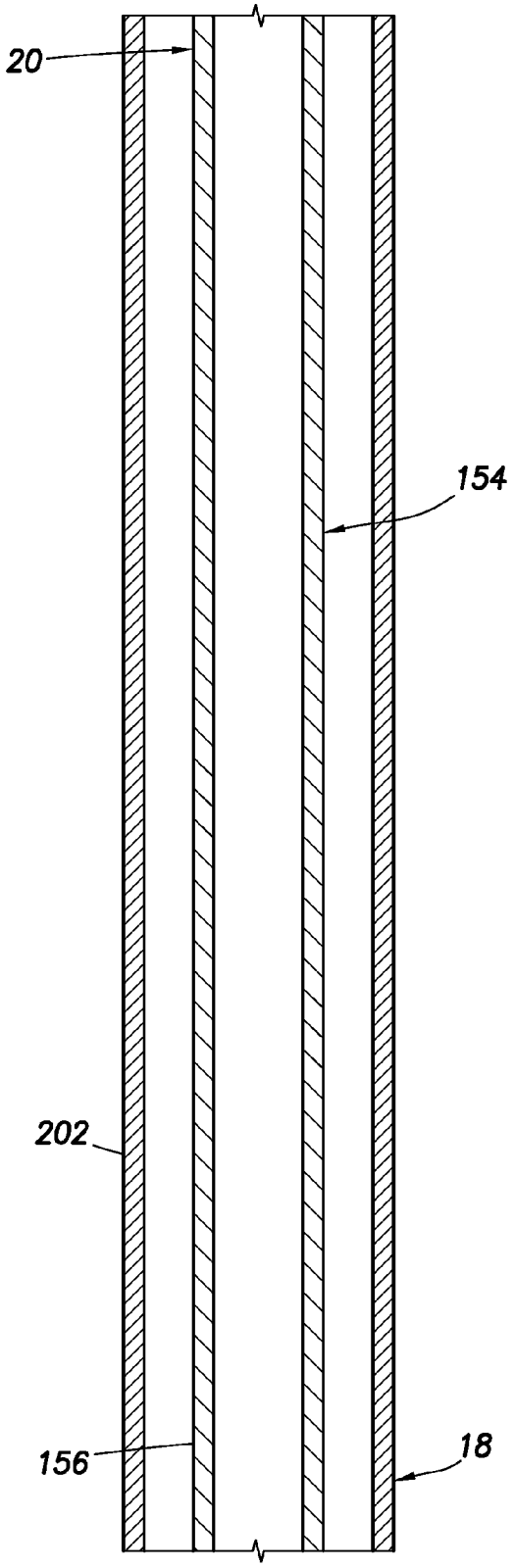
Figure 2K:
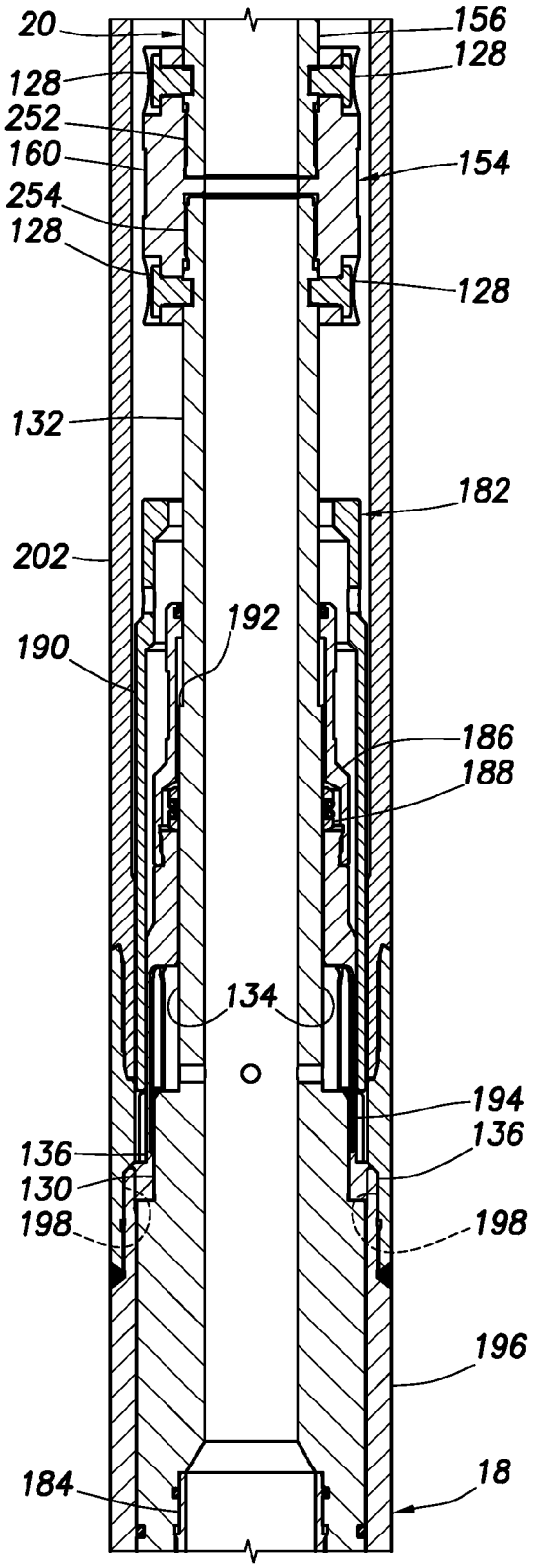
Figure 2L:
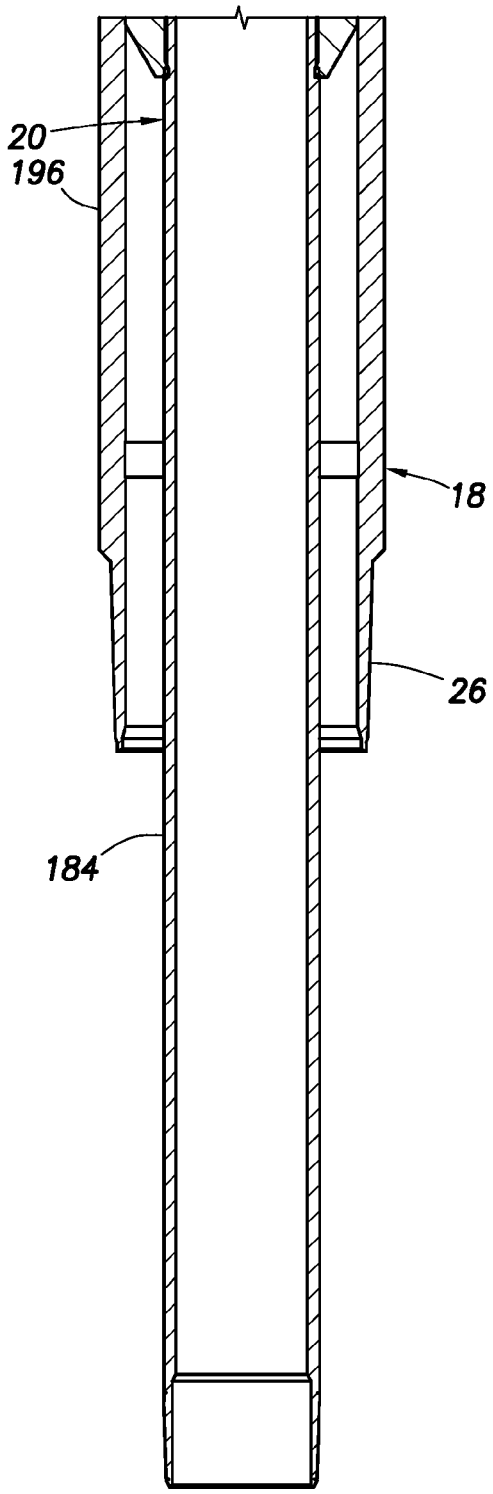
Figure 13A:
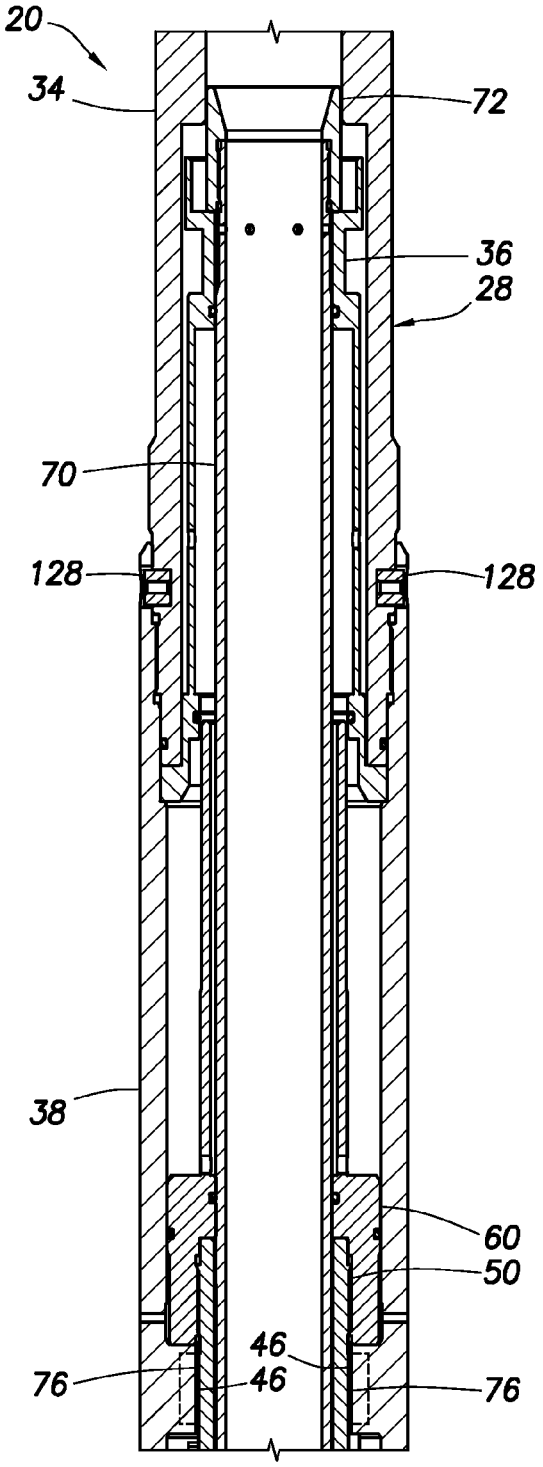
FIGS. 13A-C are cross-sectional views of portions of the running tool and liner hanger in an alternative setting procedure.
Figure 13B:
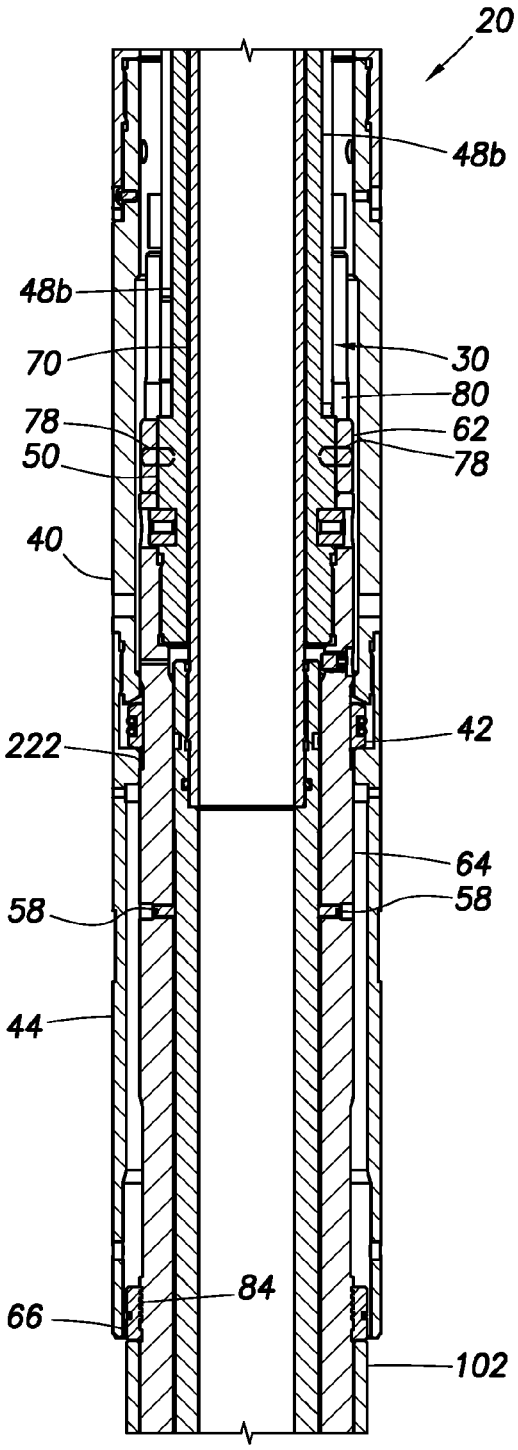

The torque ring 62 is assembled on the lower end of the slot mandrel 50 and is held in place with shear pins 78 (not visible in FIG. 2B, see FIG. 13B). The torque ring 62 has longitudinal slots 80 in its upper end machined so that when the lugs 46 are at the lower end of the short slots 48*a*, left-hand torque is transferred from the lug body 38 to the torque ring, the shear pins 78, and the slot mandrel 50.

As long as the shear pins 78 between the torque ring 62 and slot mandrel 50 are not sheared, the lugs 46 will remain in the short slots 48*a*. If the lugs 46 are moved to the lower end of the short slots 48*a* and enough left-hand torque is applied to shear the shear pins 78, the lugs can be rotated to align with the long slots 48*b*.

The piston mandrel 64 is made up on the lower end of the slot mandrel 50. It has a set of external grooves 84 formed thereon. The release lock 66 is assembled in the grooves 84 and is held in place with the locking dogs retainer 44.

The piston 68 is made up in the lower end of the piston mandrel 64 and is held in place with shear pins 58. The lower end of the piston 68 holds a flapper valve 86 open.

An external upset and seal 88 at the lower end of the piston 68 seals against an interior of the piston mandrel 64. There is also an internal upset at the lower end which provides a seat 90 for a ball.

Above the external upset and seal 88 are fluid ports 92. Above the fluid ports 92 is a smaller external upset and seal 93 which seals against a smaller ID in the piston mandrel 64.

The valve release sleeve 70 is made up in the upper end of the piston 68 and extends through the slot mandrel 50, shoe 60, and baffle 36. The cap 72 is made up on the upper end of the valve release sleeve 70.

The valve sleeve mandrel subassembly 32 is made up on the lower end of the piston mandrel 64. It consists of the valve sleeve mandrel 94, flapper valve 86, valve seat 96, valve sleeve 98, crossover body 100, crossover sleeve 102, adjusting sleeve 104, and crossover body retainer 106.

The flapper valve 86 is assembled on the valve seat 96 with a pin and torsion spring 108. The valve seat 96 is made up on the upper end of the valve sleeve 98.

The valve sleeve 98 is inserted in the upper end of the valve sleeve mandrel 94 and is held in place with shear pins 110. It has external seals 112 that seal off flow ports 114 through the valve sleeve mandrel 94. It also has flow ports 116 that are aligned with the flow ports 114 in the valve sleeve mandrel 94 when the valve sleeve 98 shifts downward.

The crossover body 100 is assembled on the exterior of the valve sleeve mandrel 94. It has a set of radial fluid ports 118, a set of radial shear pin access holes 120, and a set of longitudinal fluid ports 122.

The longitudinal fluid ports 122 allow pressure to bypass around the flapper valve 86 when it is closed and act on the force multiplier 124 and expansion cone 126. The radial fluid ports 118 allow fluid displaced by the force multiplier 124 and expansion cone 126 to flow to the exterior of the running tool 20. The radial shear pin access holes 120 allow access to the shear pins 110 holding the valve sleeve 98 in the valve sleeve mandrel 94 after the running tool 20 is assembled so shear pins can be added or removed without disassembling the running tool.

The crossover body retainer 106 is made up on the valve sleeve mandrel 94 and provides a lower shoulder to the crossover body 100, limiting its downward movement.

The adjusting sleeve 104 is made up on the lower end of the crossover body 100. It is used to adjust for tolerances in the running tool 20 assembly and liner hanger 18, ensuring the expansion cone 126 is assembled tightly against the liner hanger.

The crossover sleeve 102 is made up on the upper end of the crossover body 100. It provides a concentric bypass around the closed flapper valve 86 for fluid used to expand the liner hanger 18. The upper end of the crossover sleeve 102 shoulders against the release lock 66 on the piston mandrel 64.

Torque pins 128 installed through various components of the running tool 20 allow left- and right-hand torque to be applied to the running tool without backing off or transmitting torque through threads of threaded connections 236, 238, 240, 242, 244, 246, 248, 250, 252, 254.

The force multiplier subassembly 124 is made up on the lower end of the valve sleeve mandrel 94. It consists of the coupling 138, force multiplier sealing mandrel 140, center coupling 142, piston spacer 144, force multiplier piston 146, and force multiplier cylinder 148.

The coupling 138 connects the valve sleeve mandrel 94 to the force multiplier sealing mandrel 140. The center coupling 142 is made up on the lower end of the force multiplier sealing mandrel 140. It seals against an interior of the force multiplier cylinder 148.

The piston 146 is made up on the upper end of the force multiplier cylinder 148 and seals against an exterior of the force multiplier sealing mandrel 140. The piston spacer 144 is made up to the upper end of the piston 146.

An annular differential piston area is created between the exterior of the force multiplier sealing mandrel 140 and the interior of the force multiplier cylinder 148, against which expansion pressure acts. This creates a downward force which pushes the lower end of the force multiplier cylinder 148 against the expansion cone subassembly 150, increasing the amount of expansion force available. Radial ports 152 at the lower end of the force multiplier sealing mandrel 140 allow fluid displaced by the downward movement of the force multiplier piston 146 and cylinder 148 to exit into the interior of the force multiplier sealing mandrel 140 and then upward and out the radial fluid ports 118 in the crossover body 100.

A sealing mandrel subassembly 154 is made up to the bottom of the center coupling 142. It consists of the sealing mandrel 156, port sealing sleeve 158, and lower coupling 160.

The port sealing sleeve 158 is connected to the sealing mandrel 156 with shear pins 162 and covers radial ports 216 through the sealing mandrel. The lower coupling 160 is made up on the lower end of the sealing mandrel 156.

The expansion cone subassembly 150 is made up on the sealing mandrel 156 and consists of the expansion mandrel 166, expansion cone 126, expansion shoe 168, retainer cap 170, wipers 172, bushings 174, and seals 176.

The expansion cone 126 is made up on the expansion mandrel 166 and is held in place with the expansion shoe 168. The retainer cap 170 is made up on the lower end of the expansion mandrel 166 and retains a seal 176, seal backups 178, and bushing 174. Another bushing 174 and wiper 172 are held in place at the upper end of the expansion mandrel 166 with set screws 180.

The collet mandrel subassembly 182 is made up on the lower end of the lower coupling 160 and consists of the collet mandrel 132, extension 184, locking dogs retainer 186, locking dogs 188, collets 136, and load transfer sleeve 190. A collet retainer 130 and the collet mandrel 132 have been combined into one part with milled slots 134 retaining the set of collets 136.

The collet mandrel 132 has an external shoulder 192 near its upper end and an external upset 194 near its lower end. Longitudinal slots 134 are machined on the upper end of this upset 194.

The extension 184 is made up on the lower end of the collet mandrel 132. The extension 184 extends beyond the lower end of the setting sleeve 196. A conventional wiper plug device or cementing plug device known as an "SSR plug set" may be made up on the lower end of the extension 184.

The collets 136 are made up in the longitudinal slots 134 on the collet mandrel 132 and have an enlarged diameter at their lower ends which are held in internal slots 198 in the setting sleeve 196 by the collet mandrel 132. This allows left- and right-hand torque to be transmitted between the collet mandrel 132 and the setting sleeve 196 via the collets 136 and slots 134, 198.

The locking dogs 188 are assembled against the upper end of the collets 136 and are held in place with the locking dogs retainer 186 which is made up on the upper end of the collets.

All load bearing connections in the running tool 20 use threads to transfer longitudinal loads between components. Torque pins 128 are used to transfer torque between components. This prevents the threaded connections from having additional longitudinal loads applied due to torque acting through the threads. The torque pins 128 also allow various machined features on adjacent components, such as slots and holes, to be easily aligned. One end of each torque pin 128 is usually assembled in holes, with the other end extending into slots. The slots allow for longitudinal adjustment as the holes on one component are rotated to align with the slots on the other component.

There are two types of torque pins 128 used in the running tool 20. The knurled torque pin is knurled on its OD and threaded on its ID. It is inserted through a slot in one component and driven into a close tolerance hole in the mating component. The knurl provides an interference fit between the torque pin and close tolerance hole which holds the torque pin in place. The internal thread on the torque pin can be used to attach the torque pin to a drive-in tool, and can be used to remove the torque pin from the close tolerance hole.

The other type of torque pin is a standard hex cap screw that has been machined at each end. The hex cap is machined down to give the head a low profile for clearance with components in the running tool 20. The lower end of the screw is machined to give a smooth OD against which the torque load is applied. This torque pin is made up in a threaded hole with the machined lower end extending into a slot machined on the mating component.

As described above, the liner hanger 18 is an expandable liner hanger that is run on the running tool 20, which in turn is made up on the bottom of the work string 22. The liner hanger 18 consists of several components connected with threaded connections: a tieback receptacle 200 on top, an expandable liner hanger body 202 in the middle, and the setting sleeve 196 on bottom.

The tieback receptacle 200 provides a sealing surface 204 for stabbing into and sealing a production string after the liner hanger 18 is set. The expandable liner hanger body 202 is the expandable component and has multiple sealing bands 206 on its exterior surface for sealing and gripping against the interior of the casing string 12.

The setting sleeve 196 has the internal slots 198 in which the collets 136 at the bottom of the running tool 20 engage to connect the running tool to the liner hanger 18. The collet mandrel 132 under the collets 136 holds them in the internal slots 198. The bottom of the setting sleeve 196 has threaded connection 26 which connects the liner hanger 18 to the liner 16 below.

Operating Procedure

The liner 16 is made up to the bottom of the liner hanger 18. A conventional SSR plug set (not shown), consisting of a top plug, or a top and bottom plug, is made up on the bottom of the extension 184 of the running tool 20, and is inserted in the interior of the liner 16 when the liner is made up to the bottom of the liner hanger 18. The bottom plug, if used, is released by displacing a ball ahead of the cement during the cementing operation. The top plug is released by dropping a dart behind the cement. Conventional floating equipment (not shown), such as a float shoe, collar, or both is made up on the bottom of the liner 16 to provide a seat for landing the cementing plugs during cementing operations.

FIGS. 2A-L depict the running in position of the running tool 20. The internal lugs 46 in the lug body 38 are positioned against the shoulder 74 at the upper end of the short slots 48*a* on the slot mandrel 50 and carry the entire weight of the running tool 20, liner hanger 18, and liner 16.

In this position, both left-hand and right-hand torque can be transferred from the lug body 38 to the slot mandrel 50, by rotating the lugs 46 against the sides of the short slots 48*a* in the slot mandrel 50. This is the position the running tool 20 should be in at the beginning of the standard setting procedure of the liner hanger 18 with the liner 16 suspended off the bottom of the wellbore 14.

Figure 3A:
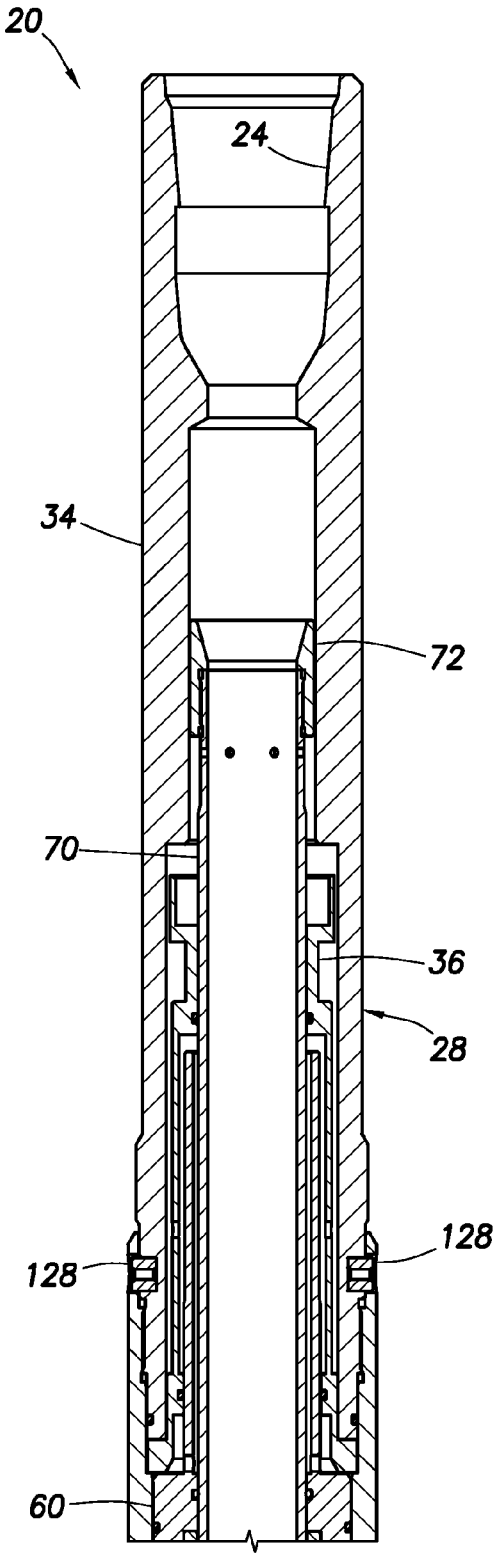
FIGS. 3A & B are cross-sectional views of a portion of the running tool after a compressive force has been applied from a work string to the running tool.

Referring additionally now to FIGS. 3A & B, cross-sectional views of a portion of the running tool 20 are representatively illustrated after a compressive force has been applied from the work string 22 to the running tool.

Representatively illustrated in FIGS. 3A & B is the upper portion of the upper adapter subassembly 28. These views depict the upper adapter subassembly 28 after it has moved downward somewhat relative to the remainder of the running tool 20. The bottom of the baffle 36 is now shouldered up against the shoe 60.

In this position, right-hand torque can be transferred from the lug body 38 to the slot mandrel 50, with the lugs 46 bearing against the sides of the short slots 48*a* in the slot mandrel. However, left-hand torque rotates the lugs 46 against the sides of slots 80 at the upper end of the torque ring 62, which is held in place on the slot mandrel 50 with shear pins 78. The amount of left-hand torque that can be applied without shearing the shear pins 78 and rotating the torque ring 62 (thereby allowing the lug body 38 to rotate relative to the slot mandrel 50) depends on the strength and number of shear pins installed.

The only time the running tool 20 should be in this configuration of FIGS. 3A & B is when pushing on the liner 16, the liner is set on bottom, during the alternate procedure to mechanically release the flapper valve 86 as described below, or during the contingency release procedure as described below. However, FIGS. 3A & B demonstrate that the running tool 20 remains operational, even though substantial compressive set-down weight is applied from the work string 22 to the liner 16 via the running tool.

After the liner 16 has been run and is suspended off the bottom of the wellbore 14, cement is displaced through the work string 22, running tool 20, and SSR plug set. The SSR plugs are released with a dart and/or ball and displaced to the float collar or shoe.

Figure 4A:
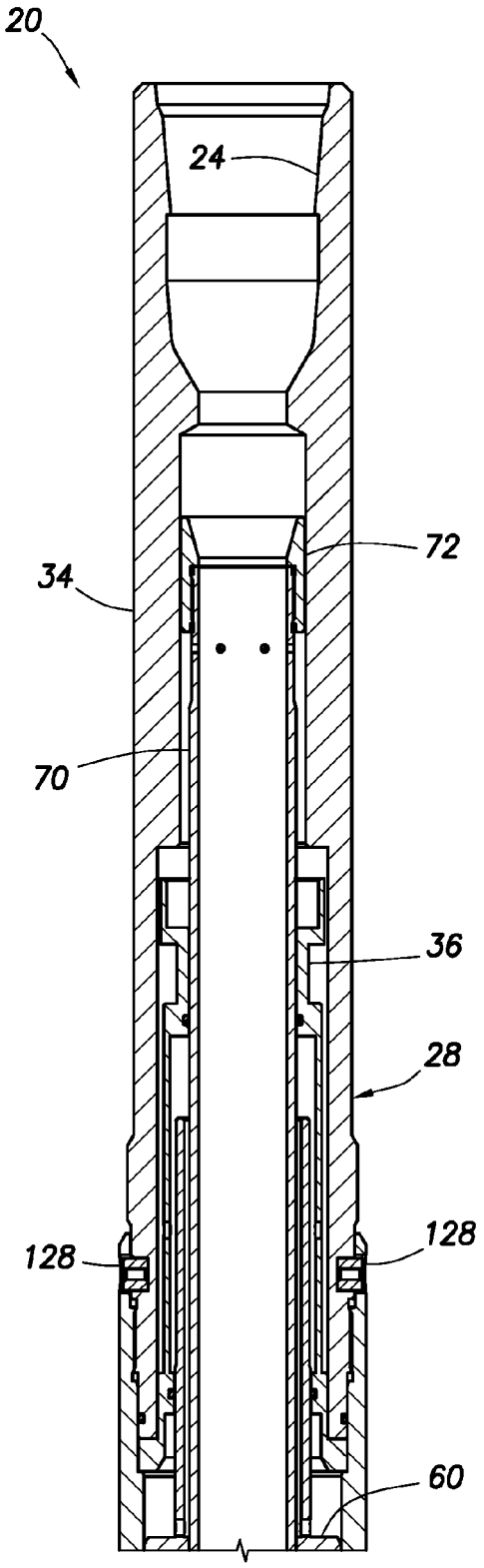
FIGS. 4A-C are cross-sectional views of a portion of the running tool at the conclusion of a cementing operation, and after a flapper valve of the running tool has been closed.
Figure 4B:
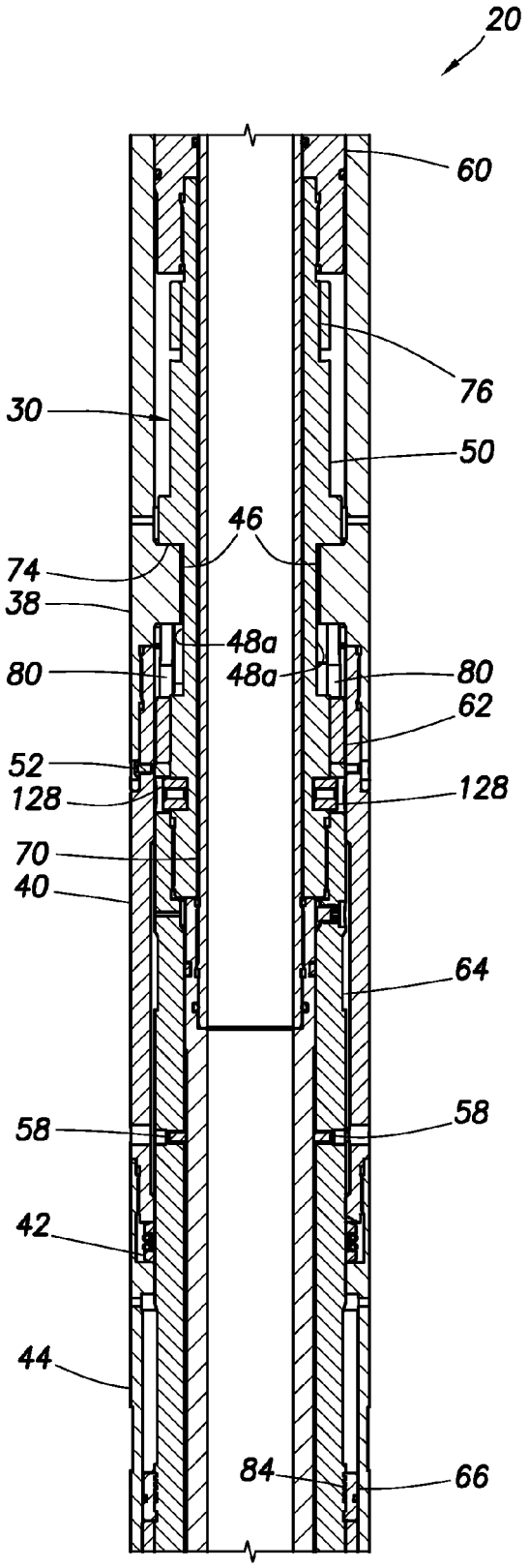
Figure 4C:
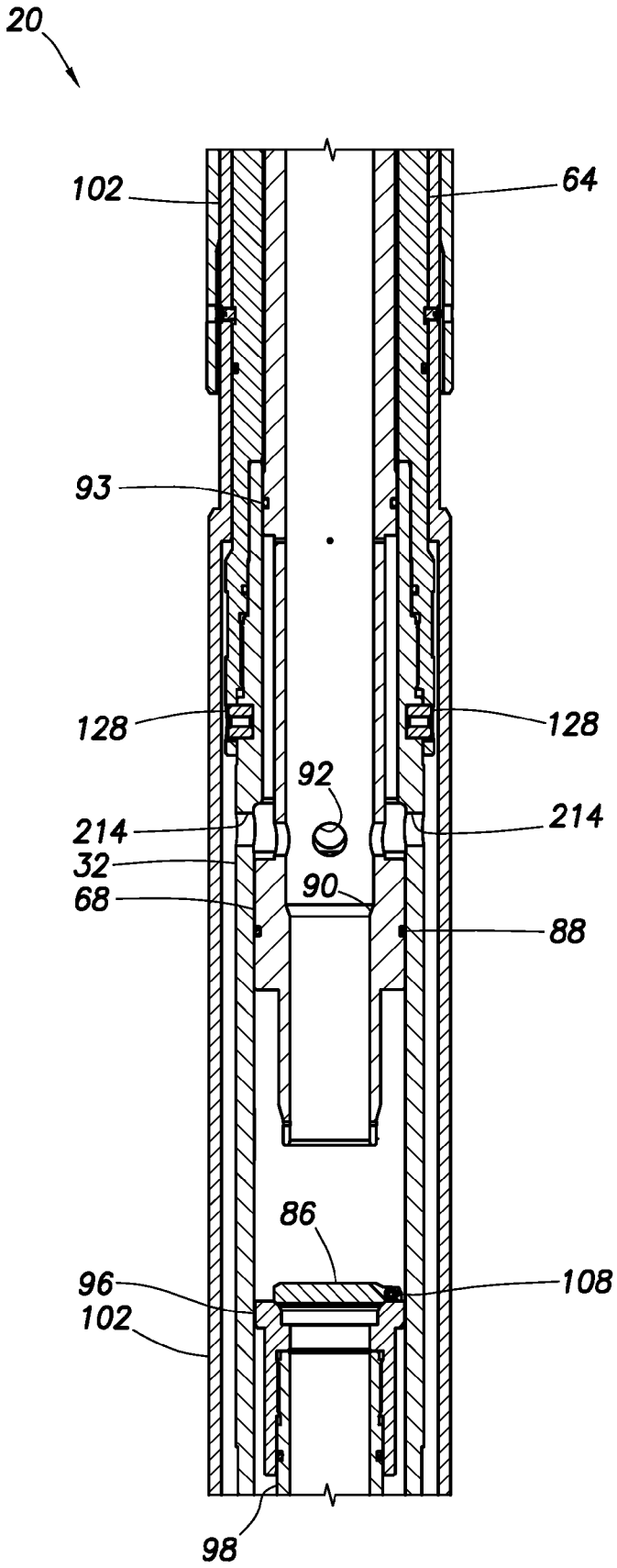

Referring additionally now to FIGS. 4A-C, cross-sectional views of a portion of the running tool 20 at the conclusion of the cementing operation, and after the flapper valve 86 of the running tool has been closed, are representatively illustrated.

FIGS. 4A-C depict the position of a portion of the running tool 20 after cement and the SSR plugs have been displaced through the tool string. The plugs have landed on the float collar or shoe, and pressure has been applied to the work string 22 to act on the differential area on the piston 68.

This pressure applied to the piston 68 causes the shear pins 58 to shear, permitting the piston to shift upward, and allowing the flapper valve 86 to close. At this point, the pressure is equal above and below the flapper valve 86. The work string 22 pressure is then relieved above the flapper valve 86 and the flapper valve opens momentarily to relieve the excess pressure below it.

Figure 5A:
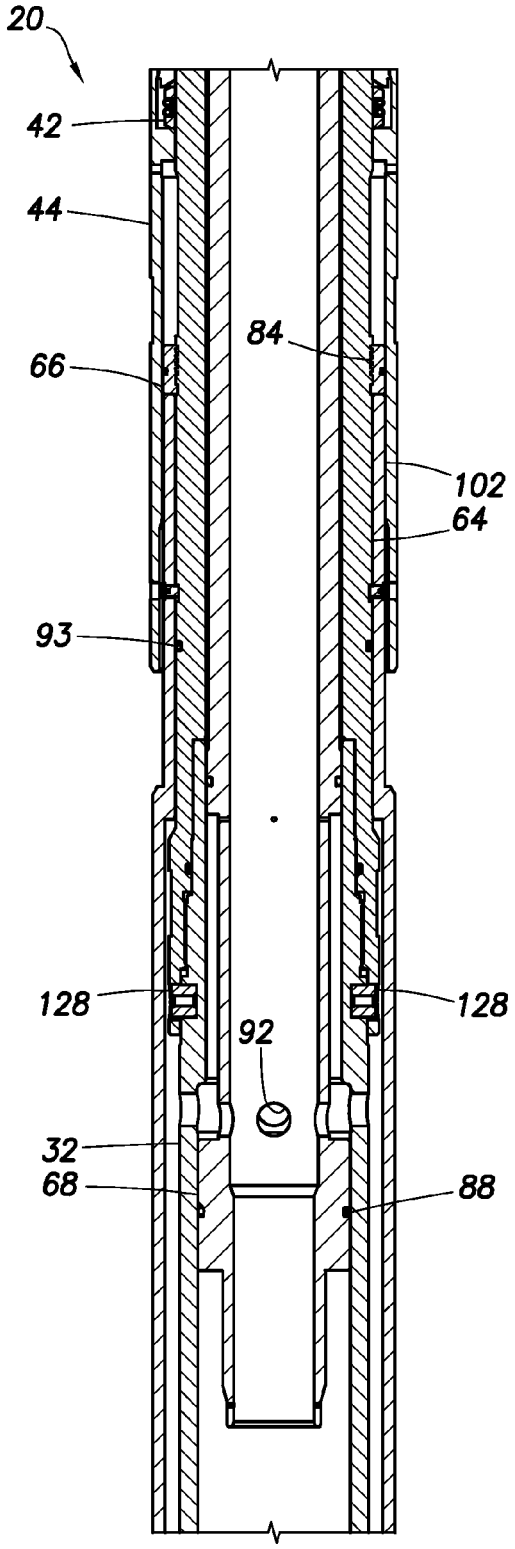
FIGS. 5A & B are cross-sectional views of a portion of the running tool after pressure applied to the work string is increased to thereby initiate expansion of the liner hanger.
Figure 5B:
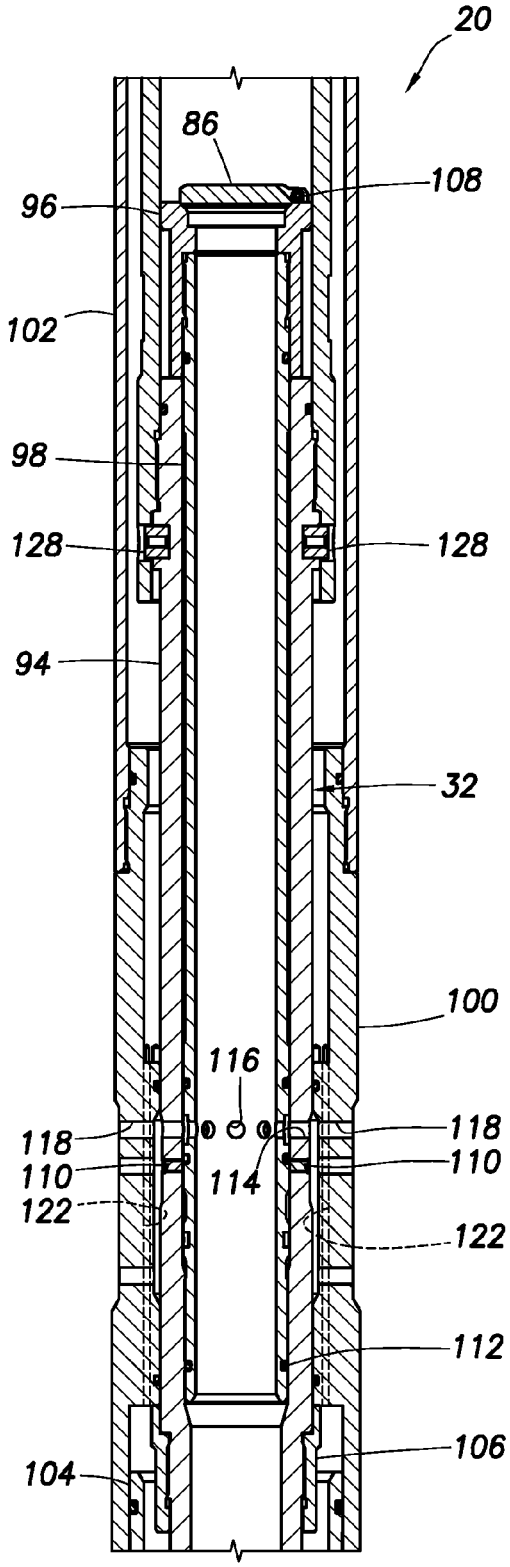

Referring additionally now to FIGS. 5A & B, cross-sectional views of a portion of the running tool 20 are representatively illustrated after pressure applied to the work string 22 is again increased to thereby initiate expansion of the liner hanger 18.

FIGS. 5A & B shows the position of the flapper valve 86 and valve sleeve 98 after pressure applied to the work string 22 above the flapper valve 86 has been increased, the pressure acting on the flapper valve, shearing shear pins 110, and shifting the flapper valve and valve sleeve 98 downward. A lower end of the valve seat 96 is now shouldered up against an upper end of the valve sleeve mandrel 94. This opens crossover ports 114, 116, 118, permitting fluid communication between the running tool 20 interior and exterior, and allowing fluid displaced during expansion of the liner hanger 18 to flow to the annulus outside the running tool.

Figure 6:
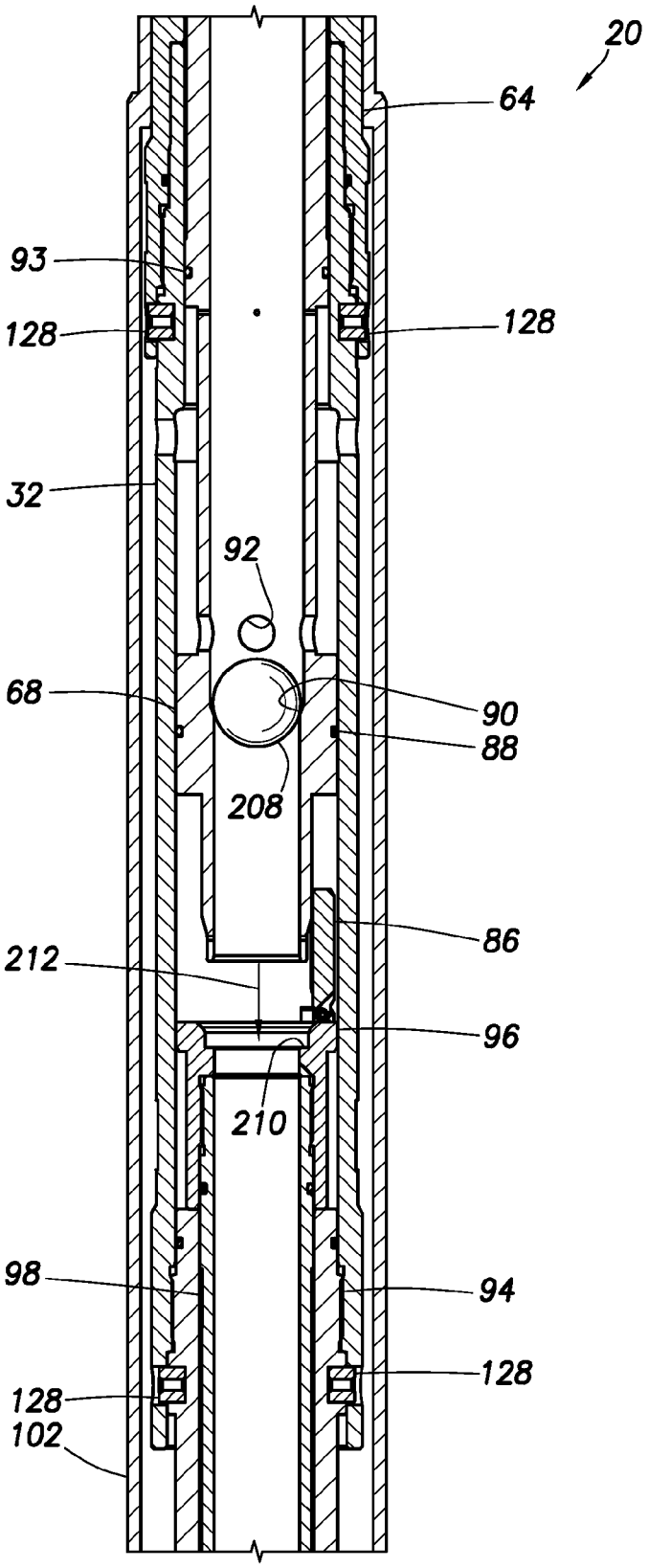
FIG. 6 is a cross-sectional view of a portion of the running tool illustrating an alternate setting procedure in the event that the flapper valve does not properly close.

Referring additionally now to FIG. 6, a cross-sectional view of a portion of the running tool 20 is representatively illustrated, depicting an alternate setting procedure in the event that the flapper valve 86 does not properly close.

FIG. 6 demonstrates that a ball 208 can be dropped to the seat 90 in the piston 68 as an alternative setting procedure, in the event that the flapper valve 86 does not close. Pressure may then be applied to shift the piston 68 downward against a shoulder 210 in the valve seat 96 as indicated by the arrow 212. In this manner, a biasing force is applied from the piston 68 to the valve sleeve 98 to shear the shear pins 110 and shift the valve sleeve downward to open crossover ports 114, 116, 118.

This alternative setting procedure may be used if there is no indication of the SSR plugs landing on the float collar or shoe, or if the work string 22 pressure to shift the piston 68 upward and release the flapper valve 86 (as depicted in FIGS. 4A-C) is higher than the burst pressure of the liner hanger 18 or liner 16. This alternative procedure is also preferably performed with the running tool 20 in a portion of the wellbore 14 that is not deviated enough to prevent the ball 208 from falling to the seat 90.

Figure 7A:
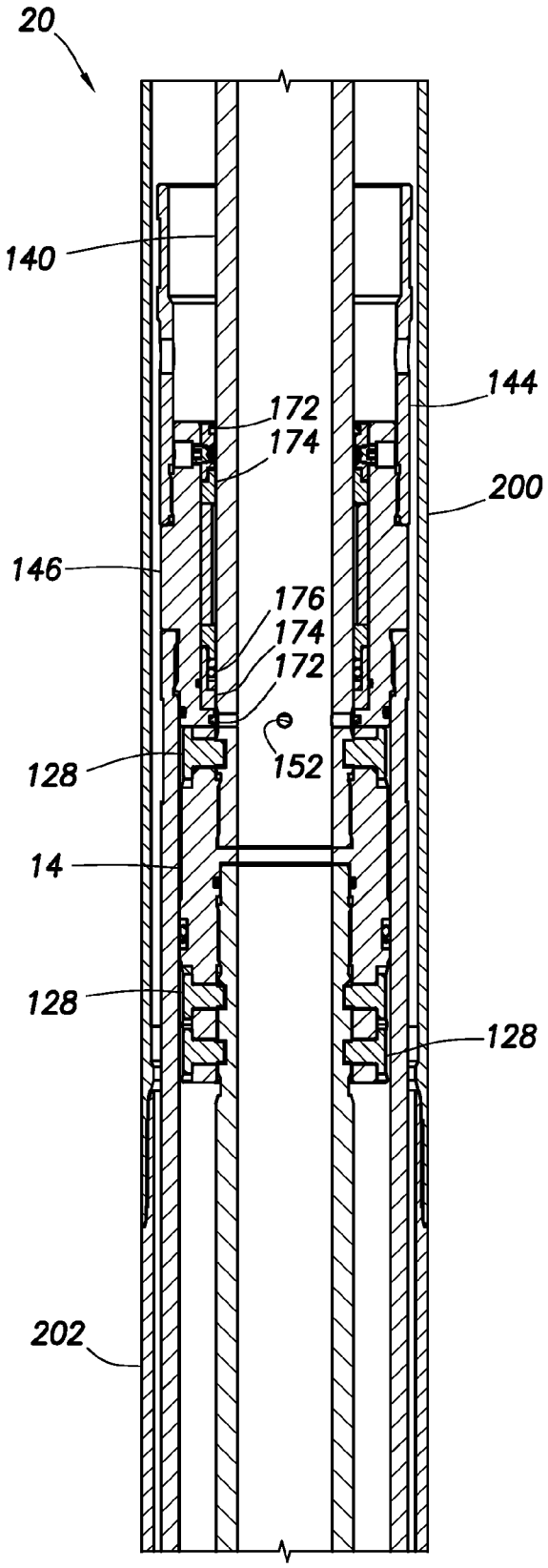
FIGS. 7A & B are cross-sectional views of portions of the running tool and liner hanger after pressure applied to the work string is further increased to thereby expand the liner hanger.
Figure 7B:
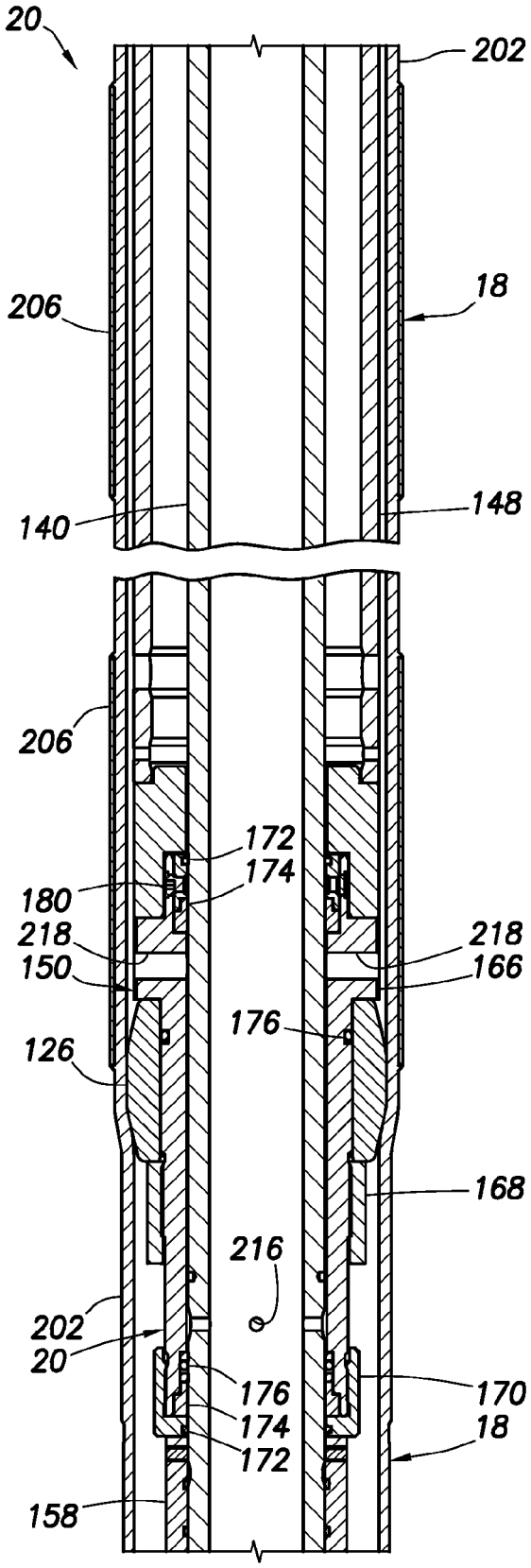

Referring additionally now to FIGS. 7A & B, cross-sectional views of portions of the running tool 20 and liner hanger 18 are representatively illustrated after pressure applied to the work string 22 is further increased to thereby expand the liner hanger.

FIGS. 7A & B depict a portion of the running tool 20 and expandable liner hanger 18 after pressure applied to the work string 22 has been increased sufficiently to expand the liner hanger by driving the expansion cone 126 downwardly through the liner hanger. The pressure in the interior of the work string 22 is communicated through radial ports 92 in the piston 68 and radial ports 214 in the piston mandrel 64, through the interior of the crossover sleeve 102, through longitudinal ports 122 formed in the crossover body 100, and down the interior of the adjusting sleeve 104.

At this point, the pressure can act on the differential area of the force multiplier subassembly 124 and increase the expansion force on the expansion cone subassembly 150. Note that it is not necessary for the running tool 20 to have a force multiplier, since in some circumstances the available expansion pressure may be great enough and/or the force required for expansion may be low enough that the force multiplier is not needed.

Pressure also goes down the annular space between the exterior of the force multiplier cylinder 148 and the interior of the tieback receptacle 200 and acts on the expansion cone subassembly 150. The expansion pressure moves the expansion cone subassembly 150 downward through the liner hanger body 202, expanding it outward against the interior of the casing string 12.

Expansion continues until the expansion cone subassembly 150 contacts the port sealing sleeve 158 and pushes it off radial ports 216 through the sealing mandrel 156. Seal 176 at the lower end of the expansion cone subassembly 150 then moves across the radial ports 216. Expansion pressure drops at this point (due to fluid communication between the interior of the force multiplier sealing mandrel 140 and the interior of the liner hanger body 202 via the ports 216 and radial ports 218 in the expansion mandrel 166), giving a surface indication that the liner hanger 18 is fully expanded.

Figure 8:
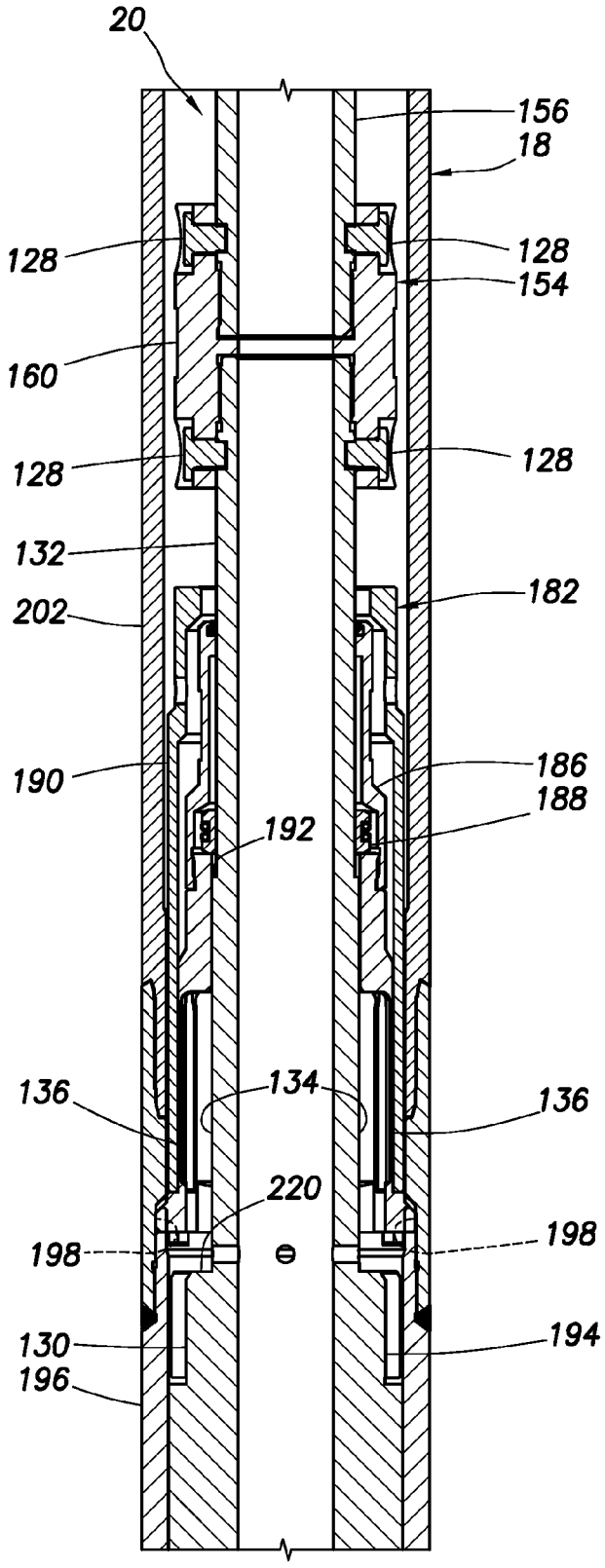
FIG. 8 is a cross-sectional view of portions of the running tool and liner hanger after compressive force has been applied from the work string to the running tool to thereby initiate release of the running tool from the expanded liner hanger.

Referring additionally now to FIG. 8, a cross-sectional view of portions of the running tool 20 and liner hanger 18 are representatively illustrated after compressive force has been applied from the work string 22 to the running tool to thereby initiate release of the running tool from the expanded liner hanger 18.

FIG. 8 depicts a portion of the running tool 20 after weight has been set down on the expanded liner hanger 18 (by slacking off on the work string 22). This moves the collet mandrel 132 out from beneath the collets 136 (i.e., the collets are no longer outwardly supported by the external upset 194 on the collet retainer 130), thereby permitting release of the collets from the internal slots 198 in the setting sleeve 196. Locking dogs 188 are now above the shoulder 192 on the collet mandrel 132, thereby preventing the collets 136 from again being outwardly supported by the collet retainer 130.

Figure 9:
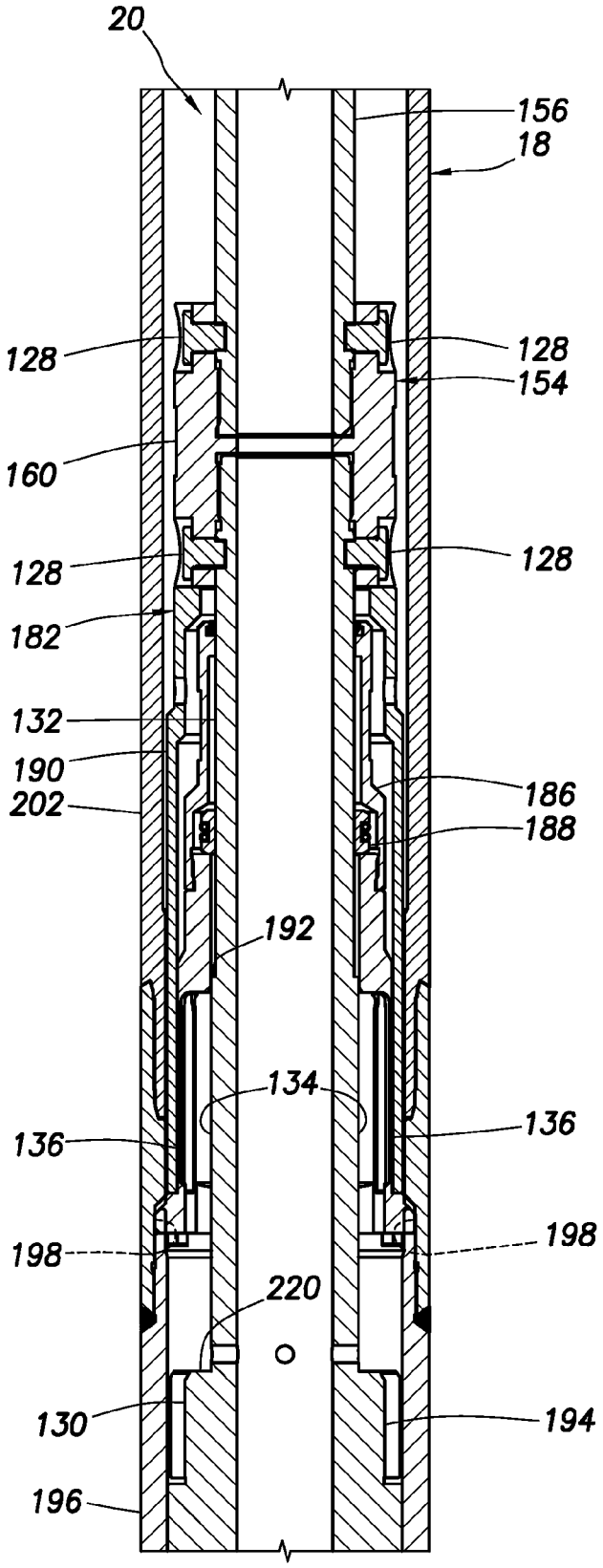
FIG. 9 is a cross-sectional view of portions of the running tool and liner hanger in a configuration similar to that of FIG. 8, but with use of an increased length tieback receptacle on the liner hanger.

Referring additionally now to FIG. 9, a cross-sectional view of portions of the running tool 20 and liner hanger 18 are representatively illustrated in a configuration similar to that of FIG. 8, but with use of an increased length tieback receptacle 200 on the liner hanger.

FIG. 9 depicts a portion of the running tool 20 in an alternative set down position. If a longer tieback receptacle 200 is used, the adjusting sleeve 104 can be configured so that its outer diameter can be inserted completely within the upper portion of the tieback receptacle (see FIG. 2D). This permits the longer tieback receptacle 200 to extend over the upper part of the running tool 20.

When setting down the running tool 20 to release the collets 136 from the setting sleeve 196, downward movement is limited by the lower coupling 160 shouldering against the top end of the load transfer sleeve 190 and the bottom end of the load transfer sleeve shouldering against the top of the upset end of the collets. Note that in this configuration the locking dogs 188 are again positioned above the shoulder 192 to thereby prevent the collets 136 from again being supported by the collet retainer 130.

Figure 10:
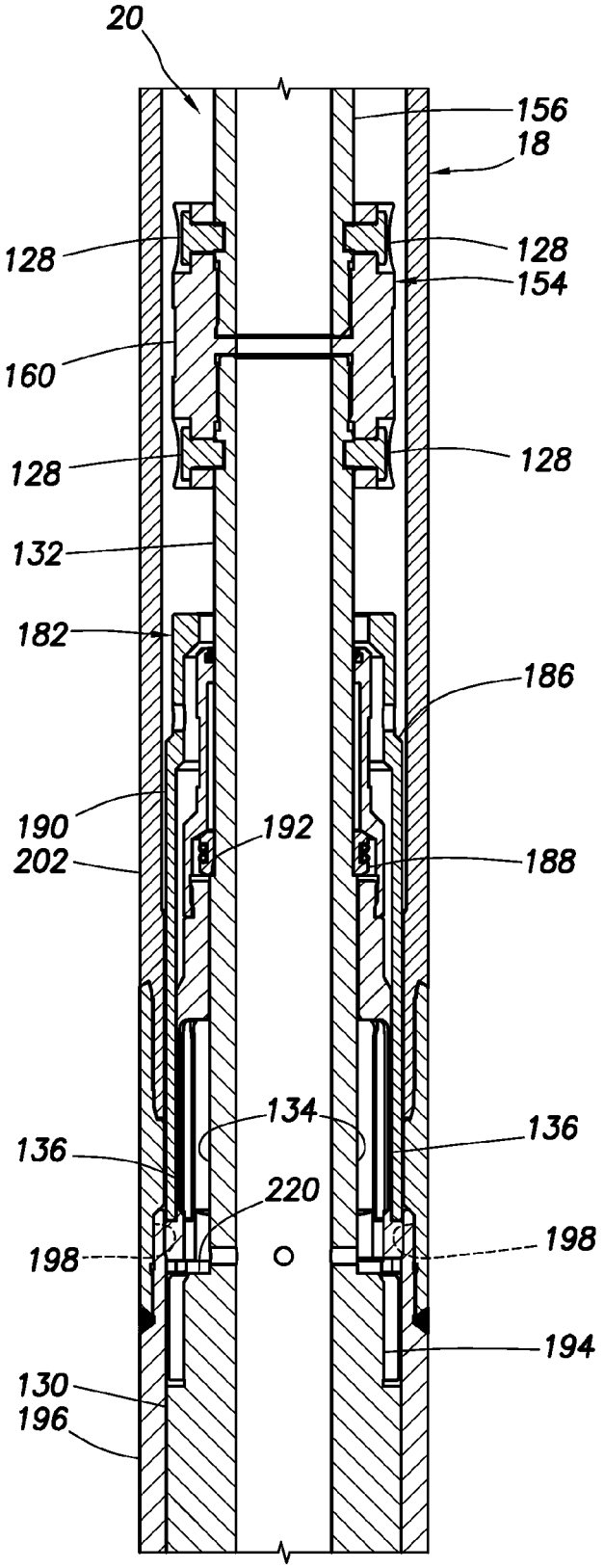
FIG. 10 is a cross-sectional view of portions of the running tool and liner hanger after the running tool has been picked up somewhat by applying tensile force from the work string to the running tool.

Referring additionally now to FIG. 10, a cross-sectional view of portions of the running tool 20 and liner hanger 18 are representatively illustrated after the running tool has been picked up somewhat by applying tensile force from the work string 22 to the running tool.

FIG. 10 depicts a portion of the running tool 20 after the running tool has moved upward until the locking dogs 188 in the collet mandrel subassembly 182 contact the shoulder 192 on the collet mandrel 132. At this point, the collets 136 are free to be pulled out of the internal slots 198 in the setting sleeve 196.

In the event that the locking dogs 188 don't engage the shoulder 192, the running tool 20 can be rotated slightly before moving upward. This will misalign the collets 136 with the slots 134 on the collet mandrel 132. Upward movement of the running tool 20 will then cause a shoulder 220 on the collet mandrel 132 to push the collets 136 out of the internal slots 198 in the setting sleeve 196.

Figure 11:
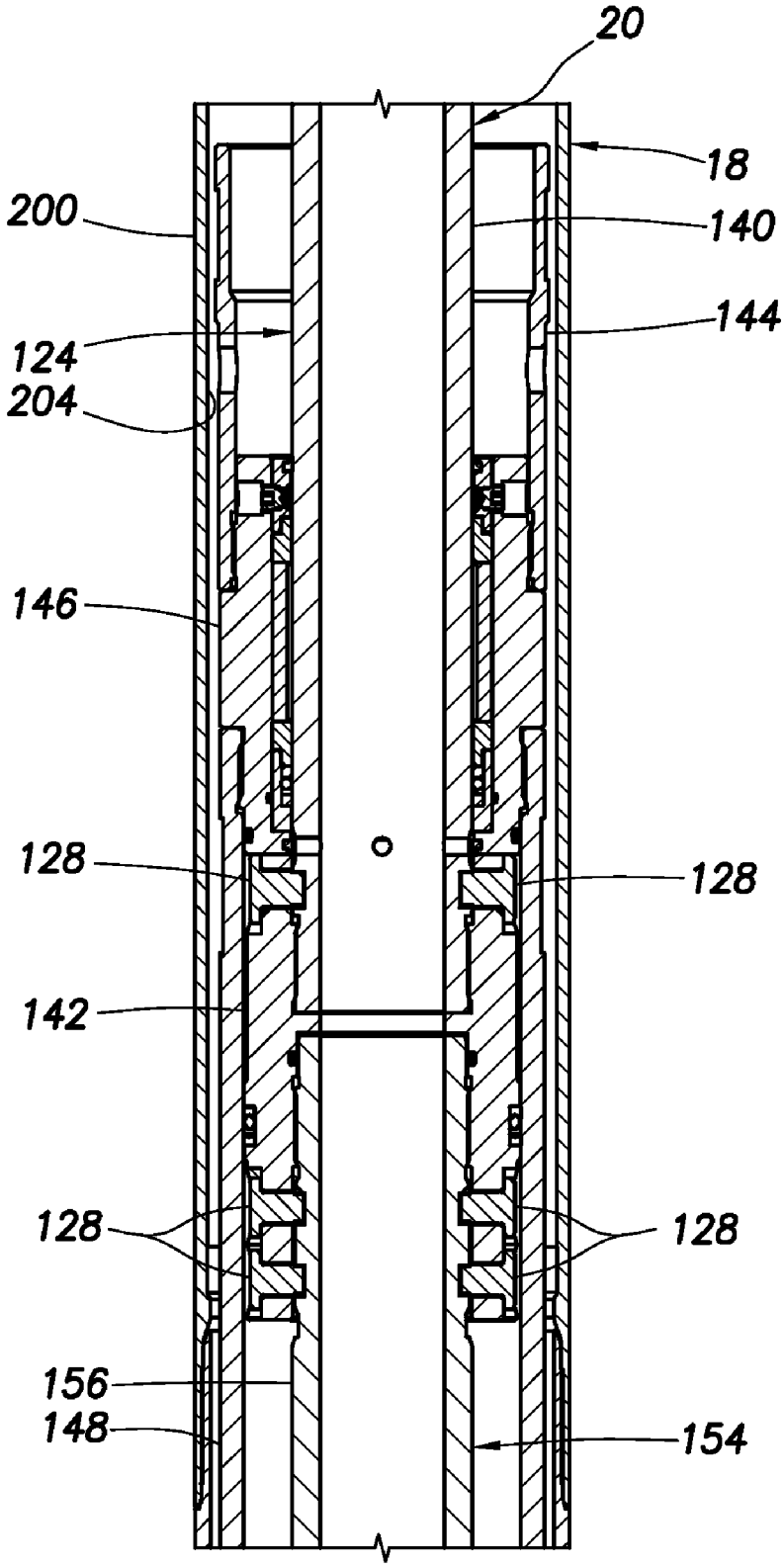
FIG. 11 is a cross-sectional view of portions of the running tool and liner hanger after the running tool has been picked up further by the work string.

Referring additionally now to FIG. 11, a cross-sectional view of portions of the running tool 20 and liner hanger 18 are representatively illustrated after the running tool has been picked up further by the work string 22.

FIG. 11 depicts a portion of the running tool 20 after further upward displacement has caused the center coupling 142 to contact the force multiplier piston 146. Still further upward displacement of the running tool 20 will cause the force multiplier subassembly 124 to displace upward as well.

Figure 12:
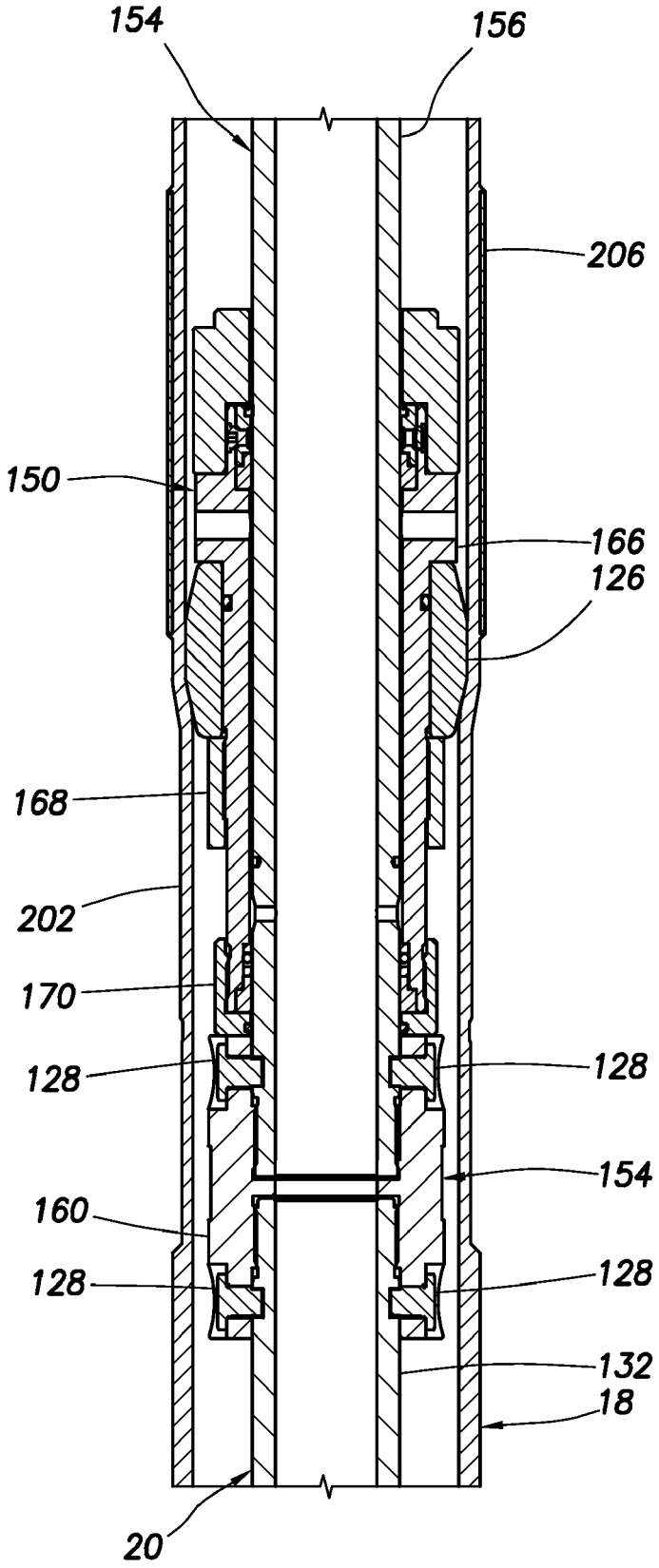
FIG. 12 is a cross-sectional view of portions of the running tool and liner hanger as the running tool is being retrieved from within the liner hanger.

Referring additionally now to FIG. 12, a cross-sectional view of portions of the running tool 20 and liner hanger 18 are representatively illustrated as the running tool is being retrieved from within the liner hanger.

FIG. 12 depicts a portion of the running tool 20 after continued upward displacement of the running tool has caused the lower coupling 160 to contact the expansion cone subassembly 150. Note that an upper end of the lower coupling 160 shoulders against a lower end of the retainer cap 170. With further upward displacement of the running tool 20, the expansion cone 126 and the remainder of the expansion cone subassembly 150 will be pulled out of the expanded liner hanger 18, and the entire running tool will be retrieved from the well.

Alternative Setting and Contingency Operation and Release Procedures

During normal running in of the liner 16, liner hanger 18 and running tool 20 suspended from the work string 22, the running tool and liner hanger will be in the configuration shown in FIGS. 2A-L. The internal lugs 46 in the lug body 38 will be positioned against the upper ends of the short slots 48*a* on the slot mandrel 50 and will carry the entire weight of the running tool 20, liner hanger 18 and liner 16.

In this position, both left-hand and right-hand torque can be transferred from the lug body 38 to the slot mandrel 50, with the lugs 46 bearing against the sides of the short slots 48*a* in the slot mandrel 50. This is the position the running tool 20 should be in at the beginning of the standard setting procedure to expand the liner hanger 18, with the liner 16 suspended off the bottom of the wellbore 14.

However, if the liner 16 contacts the bottom of the wellbore 14, or if the liner becomes stuck in the wellbore, compressive force can be transmitted from the work string 22 to the running tool 20 via the upper adapter subassembly 28. The upper adapter subassembly 28 will move down relative to the piston mandrel subassembly 30 as depicted in FIGS. 3A & B, with the bottom of the baffle 36 shouldering against the shoe 60.

In this position, right-hand torque can be transferred from the lug body 38 to the slot mandrel 50, with the lugs 46 bearing against the sides of the short slots 48*a* in the slot mandrel. However, left-hand torque causes the lugs 46 to bear against the sides of slots 80 at the upper end of the torque ring 62, which is held in place on the slot mandrel 50 with shear pins 78.

The amount of left-hand torque that can be applied depends on the strength and number of shear pins 78. When the left-hand torque is great enough to shear the shear pins 78, the lugs 46 rotate until they are aligned with the long slots 48*b* in the slot mandrel 50.

The running tool 20 should be in this position (after applying left-hand torque and shearing the shear pins 78) when beginning the procedure to either: 1) mechanically release the flapper valve, or 2) emergency release the running tool from the liner hanger 18. To be in this position, the liner 16 will be set on the bottom of the wellbore 14 or stuck in a tight spot in the wellbore.

Figure 13C:
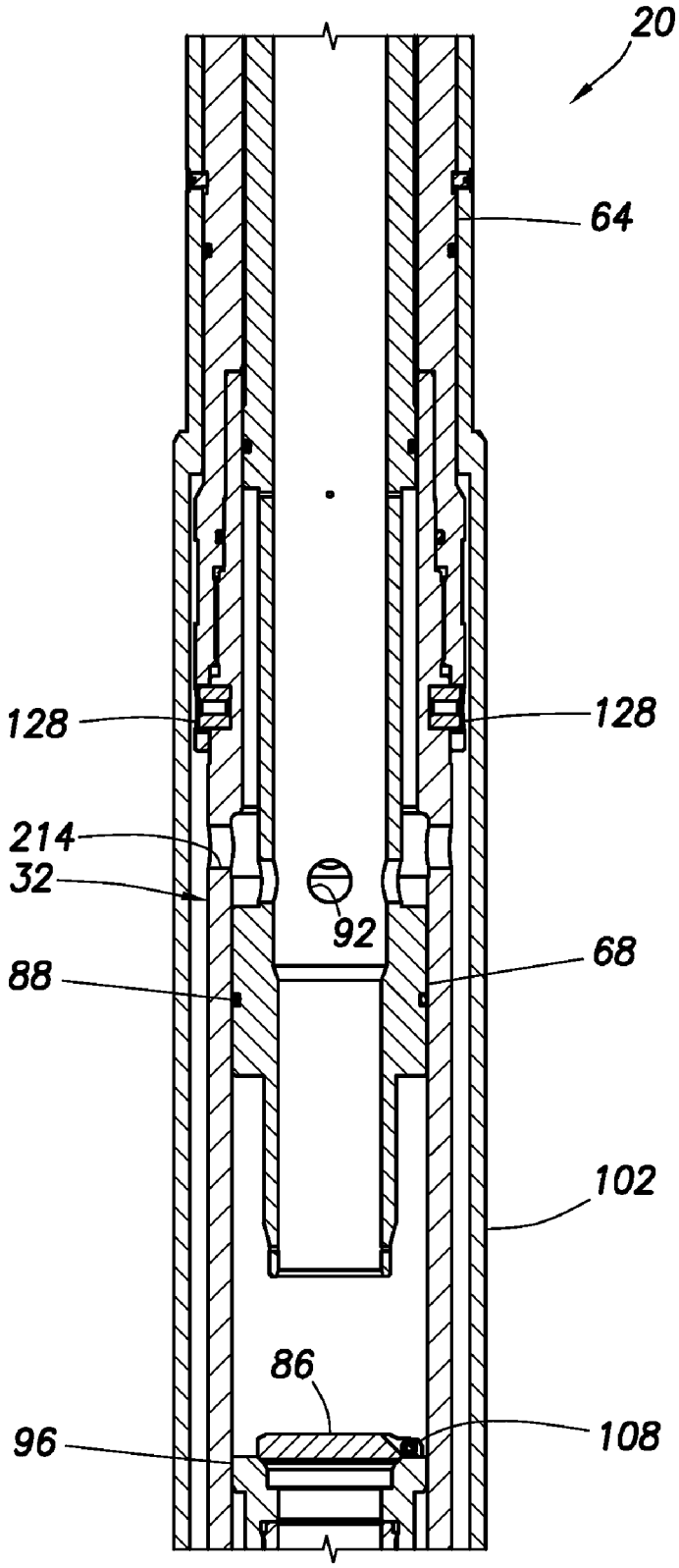

Referring additionally now to FIGS. 13A-C, cross-sectional views of portions of the running tool 20 and liner hanger 18 are representatively illustrated in an alternative setting procedure.

FIGS. 13A-C depict a portion of the running tool 20 after the upper adapter subassembly 28 has subsequently been moved upward until the lugs 46 contact a lower end of the shoe 60 at the upper end of the long slots 48*b*. This upward movement of the upper adapter subassembly 28 does several things, including: 1) the locking dogs 42 displace above an external shoulder 222 on the piston mandrel 64, 2) the locking dogs retainer 44 displaces upward and releases the release lock 66 at the upper end of the crossover sleeve 102, and 3) the baffle 36 contacts the cap 72 and pulls the piston 68 upward, thereby releasing the flapper valve 86.

At this point, right-hand (clockwise as viewed from the surface) torque can be applied to rotate the lugs 46 into pockets 76 at the top end of the long slots 48*b*. This gives the lugs 46 a shoulder to push down against when releasing the running tool 20 from the liner hanger 18. If the lugs 46 do not rotate into the pockets 76, the locking dogs 42 will contact the external shoulder 222 on the piston mandrel 64 to push down against when releasing the running tool 20 from the liner hanger 18.

If it is desired to set the liner hanger 18, the liner 16 may be lifted off of the bottom of the wellbore 14 to ensure the running tool 20 is in tension for the expansion operation.

Figure 14:
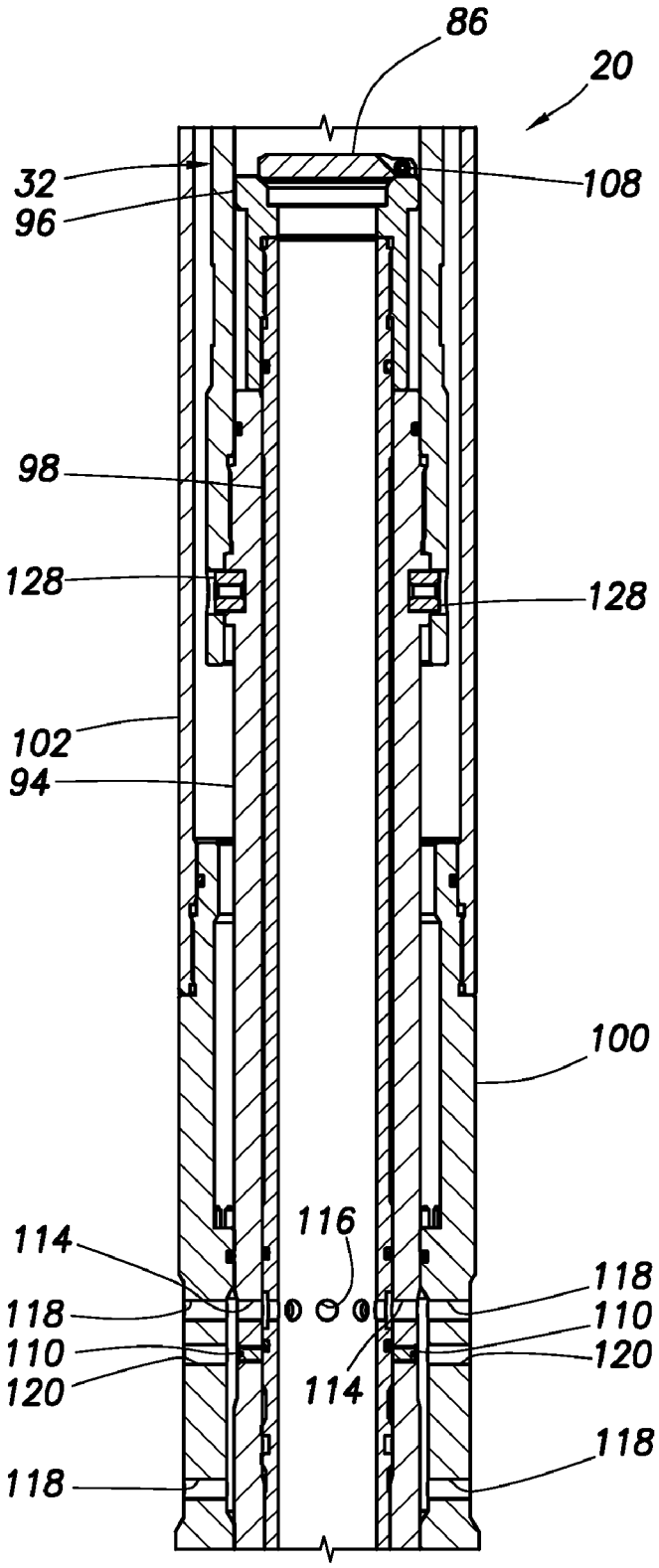
FIG. 14 is a cross-sectional view of a portion of the running tool in the alternative setting procedure after pressure has been applied to the work string to initiate expansion of the liner hanger.

Referring additionally now to FIG. 14, a cross-sectional view of a portion of the running tool 20 in the alternative setting procedure is representatively illustrated after pressure has been applied to the work string 22 to initiate expansion of the liner hanger 18.

FIG. 14 depicts a portion of the running tool 20, illustrating the position of the flapper valve 86 and valve sleeve 98 after pressure applied to the work string 22 above the flapper valve has been increased. The pressure differential across the flapper valve 86 shears the shear pins 110, and shifts the flapper valve and valve sleeve 98 downward. This opens crossover ports 118, 116, 114 and permits fluid communication between the interior and exterior of the running tool 20, and allows fluid displaced during expansion of the liner hanger 18 to flow to the annulus outside the running tool.

The setting procedure from this point on, including retrieval of the running tool 20, is the same as the standard setting procedure described above and representatively illustrated in FIGS. 8-12.

Figure 15A:
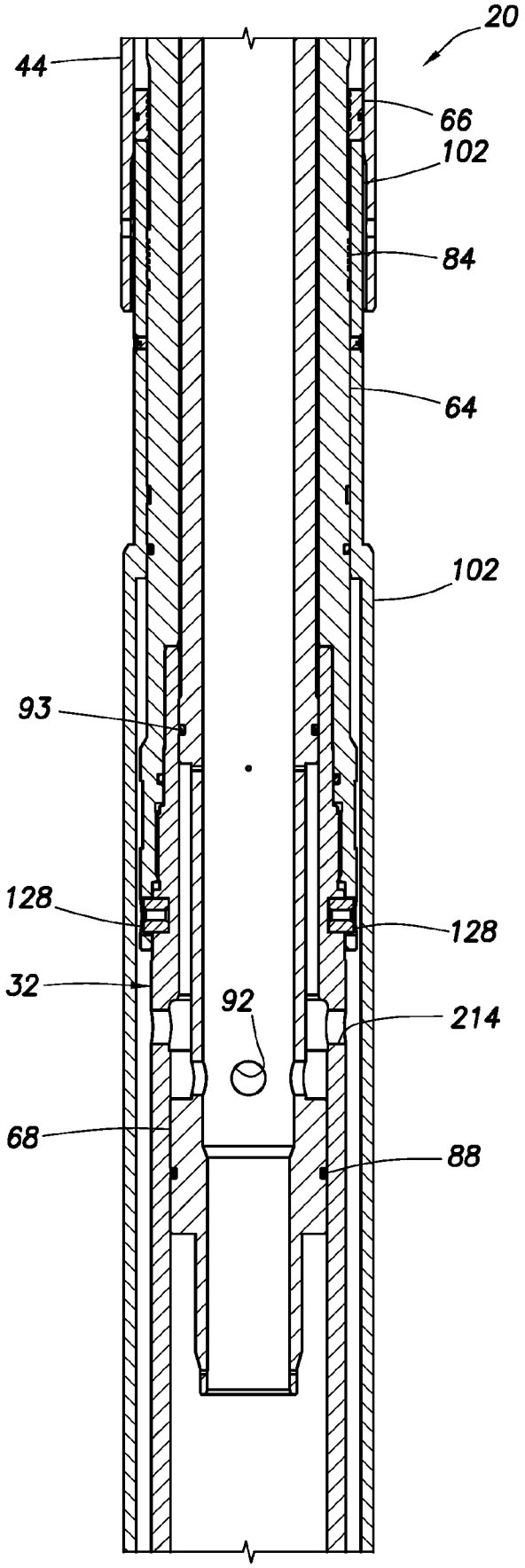
FIGS. 15A-C are cross-sectional views of portions of the running tool and liner hanger in a contingency release procedure, and after a compressive force has been applied from the work string to the running tool.
Figure 15B:
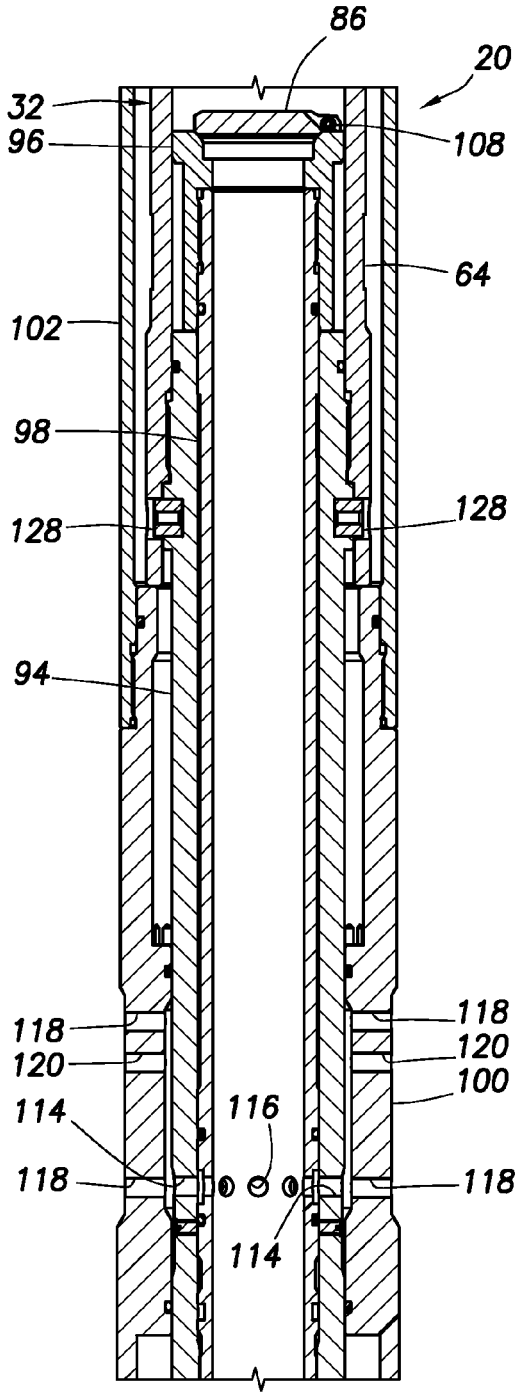
Figure 15C:
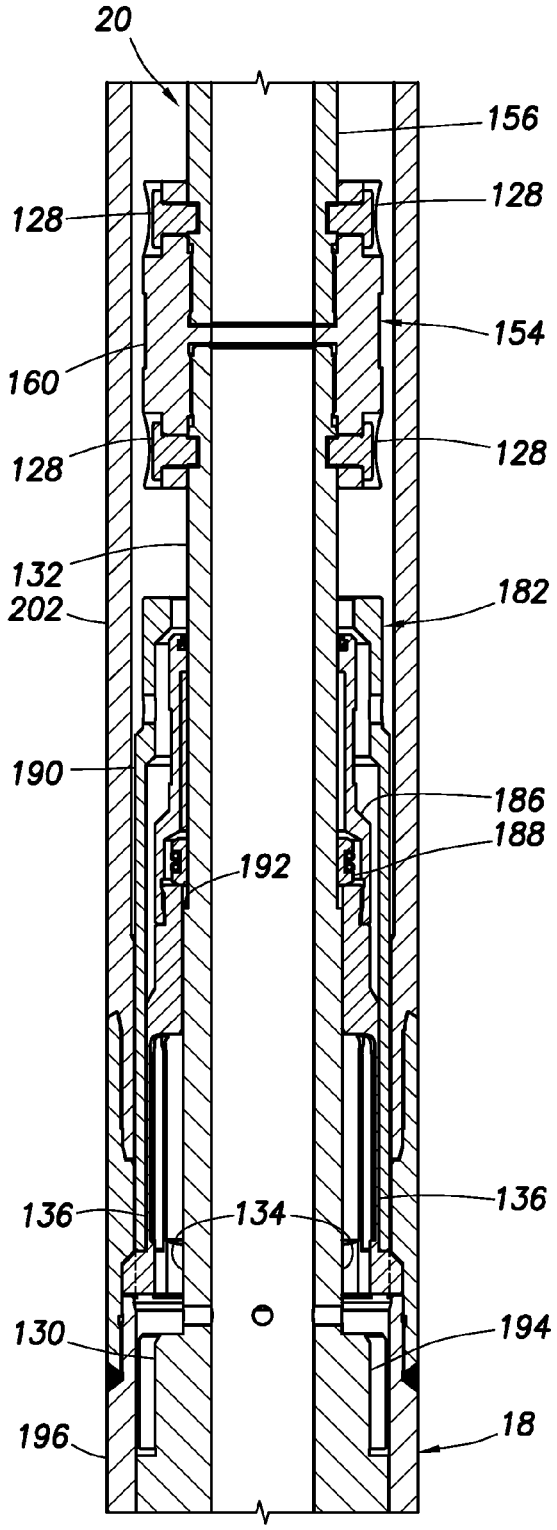

Referring additionally now to FIGS. 15A-C, cross-sectional views of portions of the running tool 20 and liner hanger 18 are representatively illustrated in a contingency release procedure, and after a compressive force has been applied from the work string 22 to the running tool.

FIGS. 15A-C depict portions of the running tool 20 and liner hanger 18 after compressive force has been applied to the upper adapter subassembly 28 by slacking off on the work string 22. This procedure is performed in order to release the running tool 20 from the liner hanger 18 after left-hand torque has been applied to shear the shear pins 78 as described above.

As depicted in FIG. 15B, the lower end of the piston mandrel 64 contacts the upper end of the crossover body 100. As depicted in FIG. 15A, the release lock 66 is pushed out of the external grooves 84 on the piston mandrel 64 by the upper end of the crossover sleeve 102.

The crossover sleeve 102, crossover body 100, adjusting sleeve 104, force multiplier subassembly 124, expansion cone subassembly 150, and liner hanger 18 remain stationary as the rest of the running tool 20 is moved downward. As depicted in FIG. 15C, this moves the collet mandrel 132 out from beneath the collets 136, releasing the collets from the liner hanger setting sleeve 196.

Locking dogs 188 in the collet mandrel subassembly 182 lock over the shoulder 192 on the collet mandrel 132. This prevents the collets 136 from again being outwardly supported by the collet retainer 130. The running tool 20 can now be retrieved from within the liner hanger 18 as described above.

Figure 16:
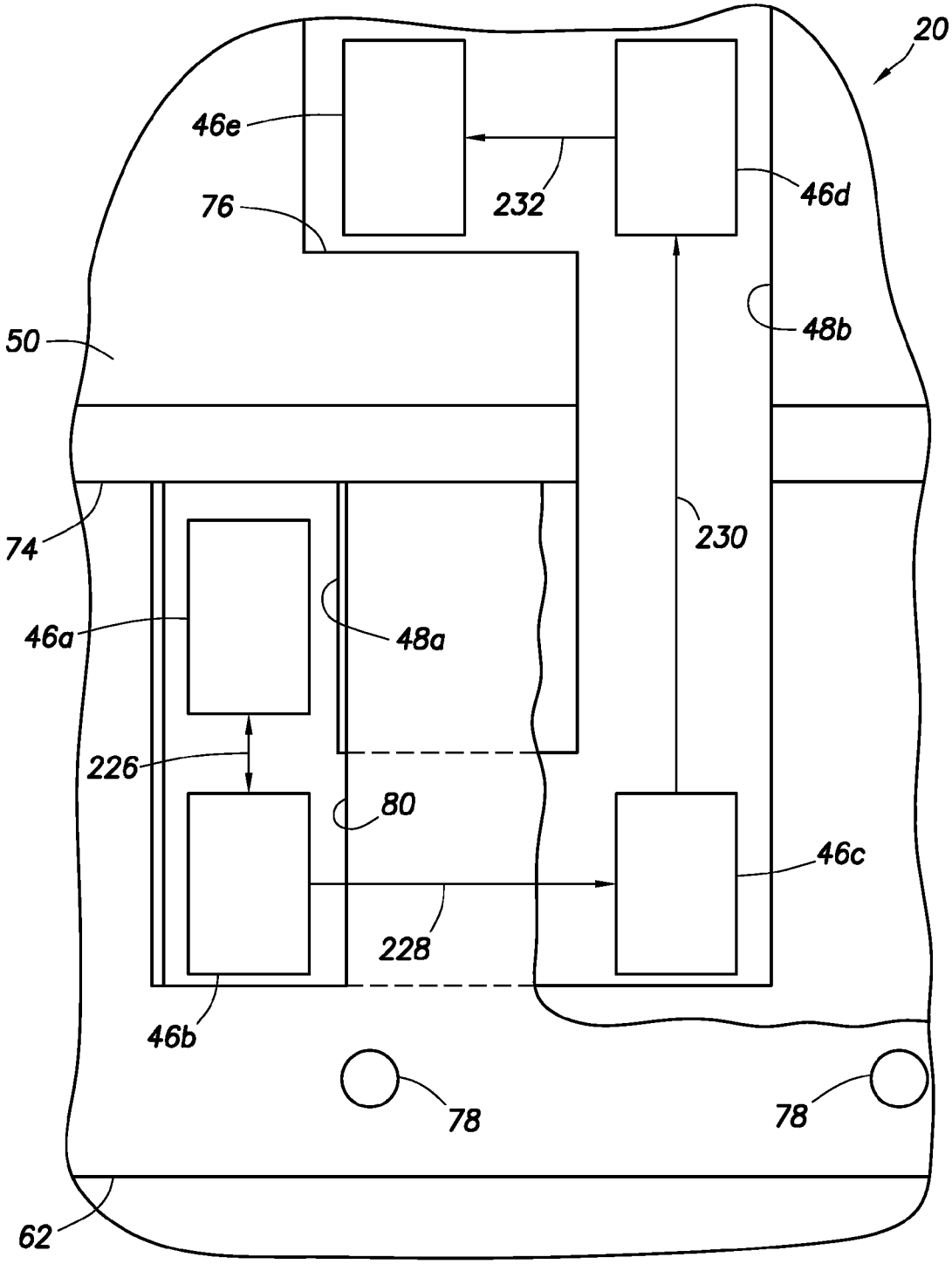
FIG. 16 is a schematic elevational "unrolled" view of a portion of the running tool, depicting various positions of lugs relative to a slot mandrel and torque ring in corresponding various procedures of running, setting and releasing the running tool.

Referring additionally now to FIG. 16, a schematic elevational "unrolled" view of a portion of the running tool 20 is representatively illustrated, depicting various positions of the lugs 46 relative to the slot mandrel 50 and torque ring 62 in corresponding various procedures of running, setting and releasing the running tool described above. Different positions of the lugs 46 are designated as 46*a-e* in FIG. 16.

In the run-in configuration of FIGS. 2A-L, the lugs 46 are in position 46*a* depicted in FIG. 16. In this position 46*a*, the lugs 46 are in the short slots 48*a* and support the weight of the remainder of the running tool 20, liner hanger 18 and liner 16.

Figure 3B:
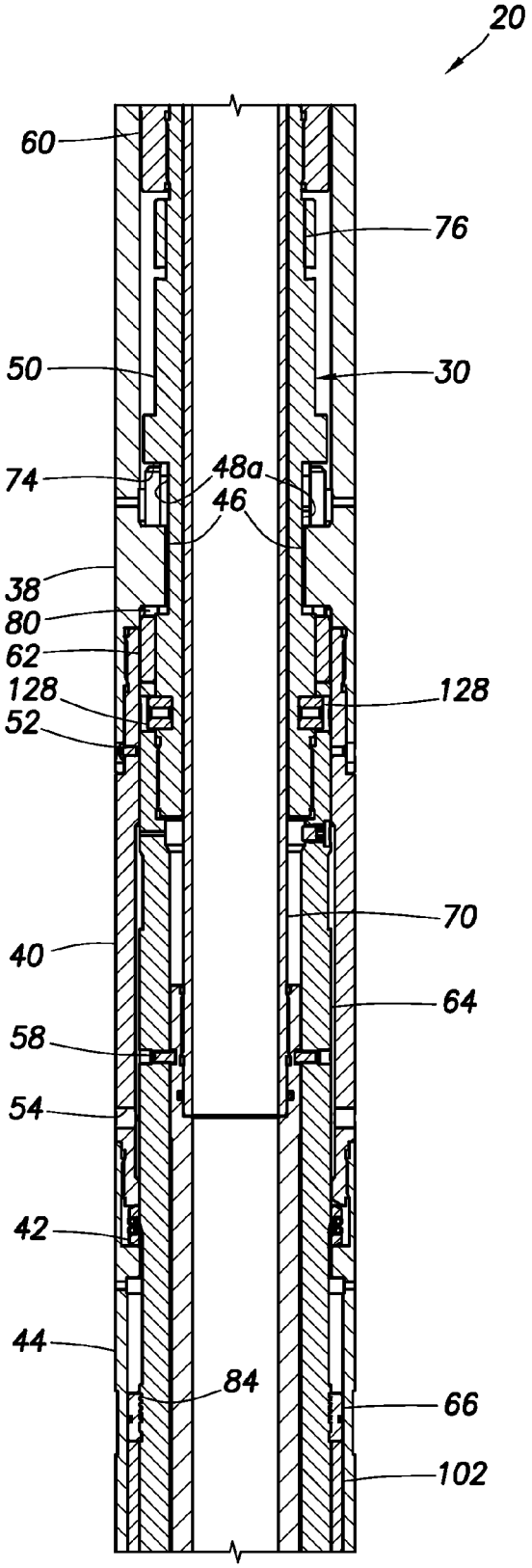

When compressive force is applied to the running tool 20 as shown in FIGS. 3A-C (such as by slacking off on the work string 22 with the liner 16 bottomed out in the wellbore 14, or stuck in the wellbore), the lugs 46 will displace to position 46*b* and enter the slots 80 on the torque ring 62 as depicted in FIG. 16. As long as left-hand torque (counter-clockwise as viewed from the surface) sufficient to shear the shear pins 78 is not applied to the running tool 20 while the lugs are in position 46*b*, any number of applications of tensile and compressive force may be applied from the work string 22 to the running tool (thereby repeatedly displacing the lugs 46 between the positions 46*a, b* as indicated by double-headed arrow 226 in FIG. 16), without causing release or premature setting of the running tool.

Left-hand torque applied to the running tool 20 which is sufficient to shear the shear pins 78 causes the lugs 46 to displace to position 46*c* as depicted in FIG. 16. This left-hand rotational displacement of the lug 46 is indicated by arrow 228 in FIG. 16. In this position of the lugs 46 (the lugs 46 being aligned with the long slots 48*b*), the running tool 20 is configured for the alternate setting procedure, or the contingency release procedure, as described above.

Tensile force applied from the work string 22 to the running tool 20 next causes the lugs 46 to displace upward in the long slots 48*b* (as indicated by arrow 230) to position 46*d* as depicted in FIG. 16, thereby initiating the alternate liner hanger 18 setting procedure. This configuration of the running tool 20 is also illustrated in FIGS. 13A-C.

To perform the contingency running tool 20 release procedure, right-hand torque is applied from the work string 22 to the running tool to thereby displace the lugs 46 into the pockets 76 as indicated by arrow 232 in FIG. 16. In this configuration, compressive force can now be applied from the work string 22 to the running tool 20 to release the running tool from the liner hanger 18, as described above.

It can now be appreciated that the above-described running tool 20 and associated methods provide many benefits to the art of expanding liner hangers. For example, the operation of the flapper valve 86 enables the liner hanger 18 to be expanded immediately after cementing instead of waiting for the operating ball 208 to fall to the seat 90. It also allows operation of the running tool 20 when placed in deviated or horizontal wellbores where the operating ball 208 might not reach the seat 90. The flapper valve 86 can be closed with or without use of the operating ball 208.

In addition, the left-hand torque contingency release procedure eliminates the possibility of premature release by removing the shear pin operated set down weight emergency release mechanisms of prior running tool designs. Instead, the running tool 20 may be released by applying set down weight only after left-hand torque has been applied to shear the shear pins 78.

Use of the torque pins 128 permits both right-hand and left-hand torque to be transmitted through the running tool 20. Torque is transmitted through the running tool 20 via the torque pins 128 without the torque being transmitted through the threaded connections 236, 238, 240, 242, 244, 246, 248, 250, 252, 254 between components of the running tool.

It will, thus, be appreciated that the above detailed description and accompanying drawings provide several new and beneficial improvements in the art of liner hanger running tools and methods. For example, a method of releasing the liner hanger running tool 20 from the liner hanger 18 can include the steps of: applying left-hand torque to the running tool; and then releasing the running tool from the liner hanger by applying a tensile force to the running tool. The releasing step may include applying a compressive force to the running tool 20 after applying the tensile force. The releasing step may further include applying a second tensile force to the running tool 20 after applying the compressive force.

The method preferably includes radially outwardly expanding at least a portion of the liner hanger 18 in the wellbore 14 prior to applying the left-hand torque to the running tool 20. The expanding step may include increasing pressure in the work string 22 used to convey the running tool 20 and liner hanger 18 into the wellbore 14, thereby biasing an expansion device (e.g., the expansion cone 126) to displace within the portion of the liner hanger.

The left-hand torque applying step may include transmitting the torque through the running tool 20 without the torque being transmitted by threads of any threaded connections 236, 238, 240, 242, 244, 246, 248, 250, 252, 254 between end connections 24, 26 of the running tool.

Also described above is a method of setting the liner hanger 18, which method includes the steps of: conveying the liner hanger into the wellbore 14 using the running tool 20; applying a compressive force to the running tool; then applying left-hand torque to the running tool; and then applying a tensile force to the running tool.

The method may further include the step of, after the tensile force applying step, applying increased pressure in the work string 22 attached to the running tool 20. The increased pressure applying step may include driving the expansion device (e.g., expansion cone 126) through at least a portion of the liner hanger 18 to thereby expand the liner hanger.

The left-hand torque applying step may further include transmitting the torque through the running tool 20 without the torque being transmitted by threads of any threaded connections 236, 238, 240, 242, 244, 246, 248, 250, 252, 254 between end connections 24, 26 of the running tool.

The method may include applying a second compressive force to the running tool 20 after the first tensile force applying step. The method may further include applying a second tensile force to the running tool 20 after the second compressive force applying step, to thereby release the running tool from the liner hanger 18.

The running tool 20 is described above for conveying and setting the liner hanger 18 in a subterranean well. The running tool 20 can include threaded connections between end connections 24, 26 at opposite ends of the running tool, with the threaded connections connecting multiple components of the running tool to each other. Torque transmitted through the running tool 20 is not transmitted by threads of the threaded connections 236, 238, 240, 242, 244, 246, 248, 250, 252, 254.

At least one torque transmitting device at each of the threaded connections prevents transmission of torque by threads of the threaded connections. For example, the torque transmitting device may include one or more torque pins 128 received in each of the components at a respective threaded connection.

The torque transmitted through the running tool 20 may be right-hand or left-hand torque. Right-hand torque is directed in a clockwise direction as viewed from above the running tool 20. Left-hand torque is directed in a counter-clockwise direction as viewed from above the running tool 20. That is, right-hand torque would otherwise operate to screw together or tighten right-hand threads, and left-hand torque would otherwise operate to loosen or unscrew right-hand threads, if not for the torque transmitting devices.

The running tool 20 may be released from the liner hanger 18 in response to the left-hand torque applied to the running tool.

The running tool 20 may be operative to expand the liner hanger 18 radially outward.

Also described above is the running tool 20 having subassemblies 28, 30, 32 capable of setting the liner hanger 18 in response to left-hand torque applied to the running tool followed by increased pressure applied to the running tool, or alternatively in response to increased pressure applied to the running tool without prior left-hand torque being applied to the running tool. The subassemblies 28, 30, 32 may include an upper adapter subassembly, a piston mandrel subassembly, and a valve sleeve mandrel subassembly.

The upper adapter subassembly 28 and piston mandrel subassembly 30 may permit substantially unlimited compressive force to be applied to the running tool 20 without initiating release of the running tool from the liner hanger 18.

The subassemblies 28, 30, 32 can include threaded connections 236, 238, 240, 242, 244, 246, 248, 250, 252, 254 between end connections 24, 26 at opposite ends of the running tool 20, with the threaded connections connecting multiple components of the running tool to each other. Torque may be transmitted through the running tool 20 without being transmitted by threads of the threaded connections.

The running tool 20 may be releasable from the liner hanger 18 in response to application of alternating tensile and compressive forces to the running tool after application of left-hand torque to the running tool.

In addition, the running tool 20 can include subassemblies 28, 30, 32, 124, 150, 154, 182 capable of releasing the running tool from the liner hanger 18 in response to application of alternating tensile and compressive forces to the running tool after application of left-hand torque to the running tool. The subassemblies 28, 30, 32, 124, 150, 154, 182 may be further capable of releasing the running tool 20 from the liner hanger 18 in response to application of compressive force to the running tool after the liner hanger has been expanded.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A method of releasing a liner hanger running tool from a liner hanger, the method comprising the steps of:

radially outwardly expanding at least a portion of the liner hanger in a wellbore;

then applying left-hand torque to the running tool, thereby shearing at least one shear element;

then applying a first tensile force to the running tool; and then applying right-hand torque to the running tool.

2. The method of claim 1, further comprising the step of applying a compressive force to the running tool after the step of applying right-hand torque.

3. The method of claim 2, further comprising the step of applying a second tensile force to the running tool after the step of applying the compressive force.

4. The method of claim 1, wherein the expanding step further comprises the step of increasing fluid pressure in a work string used to convey the running tool and liner hanger into the wellbore, thereby biasing an expansion device to displace within the portion of the liner hanger.

5. A method of releasing a liner hanger running tool from a liner hanger, the method comprising the steps of:

applying left-hand torque to the running tool, thereby shearing at least one shear element;

then applying a first tensile force to the running tool; and then applying right-hand torque to the running tool, wherein the left-hand torque applying step further comprises transmitting the torque through the running tool without the torque being transmitted by threads of any threaded connections positioned between end connections of the running tool.

6. A method of setting a liner hanger, the method comprising the steps of:

conveying the liner hanger into a wellbore using a running tool;

expanding at least a portion of the liner hanger;

applying a first compressive force to the running tool;

then applying left-hand torque to the running tool, thereby shearing at least one shear element; and then applying a first tensile force to the running tool.

7. The method of claim 6, further comprising the step of, after the first tensile force applying step, applying increased fluid pressure in a work string attached to the running tool.

8. The method of claim 7, wherein the increased fluid pressure applying step further comprises driving an expansion device through the portion of the liner hanger, thereby expanding the liner hanger.

9. The method of claim 6, further comprising the step of applying a second compressive force to the running tool after the first tensile force applying step.

10. The method of claim 9, further comprising the step of applying a second tensile force to the running tool after the second compressive force applying step, to thereby release the running tool from the liner hanger.

11. A method of setting a liner hanger, the method comprising the steps of:

conveying the liner hanger into a wellbore using a running tool;

applying a first compressive force to the running tool;

then applying left-hand torque to the running tool, thereby shearing at least one shear element; and then applying a first tensile force to the running tool, wherein the left-hand torque applying step further comprises transmitting the torque through the running tool without the torque being transmitted by threads of any threaded connections positioned between end connections of the running tool.

12. An apparatus for conveying and setting a liner hanger in a subterranean well, the apparatus comprising:

a running tool which expands the liner hanger radially outward;

at least one threaded connection positioned between opposite ends of the running tool, the threaded connection connecting a first threaded component of the running tool to a mating second threaded component of the running tool; and wherein torque transmitted from the first threaded component to the second threaded component is not transmitted by threads of the threaded connection.

13. The apparatus of claim 12, wherein at least one torque transmitting device prevents transmission of torque by threads of the threaded connection.

14. The apparatus of claim 13, wherein the torque transmitting device comprises at least one torque pin received in each of the first and second threaded components.

15. The apparatus of claim 12, wherein the torque is right-hand torque.

16. The apparatus of claim 12, wherein the torque is left-hand torque.

17. The apparatus of claim 16, wherein the running tool releases from the liner hanger in response to the left-hand torque applied to the running tool.

18. A running tool for conveying and setting a liner hanger in a subterranean well, the running tool comprising:

subassemblies which set the liner hanger in response to left-hand torque applied to the running tool followed by increased fluid pressure applied to the running tool, and in response to increased fluid pressure applied to the running tool without prior left-hand torque being applied to the running tool.

19. The running tool of claim 18, wherein the subassemblies include an upper adapter subassembly, a piston mandrel subassembly, and a valve sleeve mandrel subassembly.

20. The running tool of claim 19, wherein the upper adapter subassembly and piston mandrel subassembly can tolerate substantial compressive force to be applied to the running tool without initiating release of the running tool from the liner hanger.

21. The running tool of claim 18, wherein the running tool is releasable from the liner hanger in response to application of alternating tensile and compressive forces to the running tool after application of left-hand torque to the running tool.

22. A running tool for conveying and setting a liner hanger in a subterranean well, the running tool comprising:

subassemblies which set the liner hanger in response to left-hand torque applied to the running tool followed by increased fluid pressure applied to the running tool, and in response to increased fluid pressure applied to the running tool without prior left-hand torque being applied to the running tool, wherein the subassemblies include threaded connections positioned between end connections at opposite ends of the running tool, the threaded connections connecting multiple components of the running tool to each other, and wherein torque transmitted through the running tool is not transmitted by threads of the threaded connections.

23. A running tool for conveying and setting a liner hanger in a subterranean well, the running tool comprising:

subassemblies which set the liner hanger in response to left-hand torque applied to the running tool followed by increased fluid pressure applied to the running tool, and in response to increased fluid pressure applied to the running tool without prior left-hand torque being applied to the running tool, wherein the running tool expands the liner hanger radially outward.

24. A running tool for conveying and setting a liner hanger in a subterranean well, the running tool comprising:

subassemblies which release the running tool from the liner hanger in response to left-hand torque applied to the running tool followed by application of a tensile force to the running tool, and in response to application of a compressive force to the running tool without prior left-hand torque being applied to the running tool.

25. The running tool of claim 24, wherein the subassemblies set the liner hanger in response to left-hand torque applied to the running tool followed by increased fluid pressure applied to the running tool, and in response to increased fluid pressure applied to the running tool without prior left-hand torque being applied to the running tool.

26. A running tool for conveying and setting a liner hanger in a subterranean well, the running tool comprising:

subassemblies which release the running tool from the liner hanger in response to left-hand torque applied to the running tool followed by application of a tensile force to the running tool, and in response to application of a compressive force to the running tool without prior left-hand torque being applied to the running tool, wherein the subassemblies include threaded connections positioned between end connections at opposite ends of the running tool, the threaded connections connecting multiple components of the running tool to each other, and wherein torque transmitted through the running tool is not transmitted by threads of the threaded connections.

* * * * *